US007779507B2

(12) United States Patent
Jung et al.

(10) Patent No.: US 7,779,507 B2
(45) **Date of Patent: *Aug. 24, 2010**

(54) VACUUM CLEANER

(75) Inventors: Jae Duck Jung, Changwon-si (KR); Ha Jong Sung, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1507 days.

This patent is subject to a terminal disclaimer.

(21) Appl. No.: 11/006,619

(22) Filed: Dec. 8, 2004

(65) Prior Publication Data

US 2005/0198768 A1 Sep. 15, 2005

(30) Foreign Application Priority Data

Mar. 11, 2004 (KR) ..... 10-2004-0016489
Mar. 11, 2004 (KR) ..... 10-2004-0016490
Mar. 11, 2004 (KR) ..... 10-2004-0016493
Apr. 9, 2004 (KR) ..... 10-2004-0024413

(51) Int. Cl.
*A47L 9/20* (2006.01)

(52) U.S. Cl. ..... 15/353; 15/352; 15/348

(58) Field of Classification Search ..... 15/348, 15/352, 353

See application file for complete search history.

(56) References Cited

U.S. PATENT DOCUMENTS 3,815,335 A 6/1974 Barneybey
6,003,196 A 12/1999 Wright et al.
6,171,356 B1 1/2001 Twerdun
6,192,550 B1 * 2/2001 Hamada et al. ..... 15/352
6,406,505 B1 6/2002 Oh et al.

(Continued)

FOREIGN PATENT DOCUMENTS

JP 2003-339596 A 12/2003

(Continued)

OTHER PUBLICATIONS

Korean Office Action dated May 27, 2009 for Application No. 10-2004-0024413.

(Continued)

*Primary Examiner*—Joseph J Hail, III
*Assistant Examiner*—Shantese McDonald
(74) *Attorney, Agent, or Firm*—Ked & Associates LLP

(57) ABSTRACT

Disclosed is a vacuum cleaner including a suction nozzle; a dust collecting assembly including a dust collecting container having an opened top surface, a top lid for opening and closing the top of the dust collecting container, an inlet, a filtering device provided in the dust collecting container, a separation plate for preventing the impurities collected in a lower part of the dust collecting container from being risen by air flow, and an outlet for discharging clean air; and a cleaner body including a dust collecting assembly receiving recess for detachably receiving the dust collecting assembly, a polluted air outlet coupled with the inlet of the dust collecting assembly, and a clean air inlet provided on an inner wall of the dust collecting assembly receiving recess, so as to face the direction of mounting the dust collecting assembly, and communicating with the outlet of the dust collecting assembly, and a clean air conduit having a fan provided therein and discharging the clean air to the outside of the vacuum cleaner.

24 Claims, 16 Drawing Sheets

U.S. PATENT DOCUMENTS

| | | | | |
|---|---|---|---|---|
| 6,434,785 | B1 | 8/2002 | Vandenbelt et al. | |
| 6,436,160 | B1 * | 8/2002 | Stephens et al. | 55/337 |
| 6,579,334 | B2 | 6/2003 | Oh et al. | |
| 6,810,557 | B2 * | 11/2004 | Hansen et al. | 15/353 |
| 6,818,032 | B2 * | 11/2004 | Bilek et al. | 55/337 |
| 6,994,739 | B2 | 2/2006 | Park | |
| 7,052,523 | B2 | 5/2006 | Murphy | |
| 7,086,119 | B2 | 8/2006 | Go et al. | |
| 7,134,165 | B2 | 11/2006 | Pullins | |
| 7,175,682 | B2 | 2/2007 | Nakai et al. | |
| 7,207,083 | B2 * | 4/2007 | Hayashi et al. | 15/347 |
| 7,360,275 | B2 | 4/2008 | Allgeier et al. | |
| 2003/0066156 | A1 * | 4/2003 | Yang | 15/327.2 |
| 2003/0131441 | A1 | 7/2003 | Murphy et al. | |
| 2005/0198767 | A1 | 9/2005 | Kang et al. | |
| 2005/0198768 | A1 | 9/2005 | Jung et al. | |
| 2005/0198769 | A1 | 9/2005 | Lee et al. | |
| 2005/0198770 | A1 | 9/2005 | Jung et al. | |
| 2005/0198771 | A1 | 9/2005 | Min et al. | |

FOREIGN PATENT DOCUMENTS

| | | | |
|---|---|---|---|
| KR | 10-2000-0039238 | A | 7/2000 |
| KR | 10-0445470 | B | 8/2004 |
| KR | 10-0487938 | B | 4/2005 |
| KR | 10-0540439 | B | 12/2005 |
| KR | 10-0572882 | | 4/2006 |

OTHER PUBLICATIONS

Korean Office Action dated May 27, 2009 for Application No. 10-2004-0016480.

Korean Office Action dated May 29, 2009 for Application No. 10-2004-0016482.

Korean Office Action dated May 29, 2009 for Application No. 10-2004-0016489.

Korean Office Action dated May 29, 2009 for Application No. 10-2004-0016490.

Korean Office Action dated May 29, 2009 for Application No. 10-2004-0016492.

Korean Notice of Allowance Dated Dec. 17, 2009.

* cited by examiner

VACUUM CLEANER

CROSS-REFERENCE TO RELATED APPLICATIONS

This application claims the benefit of Korean Application No. P2004-16489, P2004-16490, and P2004-16493, three of which were filed on Mar. 11, 2004 and P2004-24413, which were filed on Apr. 9, 2004, and are hereby incorporated by reference as if fully set forth herein.

BACKGROUND OF THE INVENTION

1. Field of the Invention

The present invention relates to a vacuum cleaner, and more particularly, to a vacuum cleaner with a dust collecting assembly detachably provided.

2. Discussion of the Related Art

In general, as an apparatus for cleaning a floor or a carpet in a room, a vacuum cleaner sucks polluted outside air containing impurities through operation of an air sucking device such as a motor provided in a cleaner body, and collects impurities separated from polluted air, and discharges cleaned air to an outside thereof.

Hereinafter, a related art vacuum cleaner will be described referring to FIG. 1. Referring to FIG. 1, the related art vacuum cleaner includes a cleaner body 1 and a suction nozzle 2. An air sucking device (not shown) such as a motor and a fan sucking interior air is provided in the cleaner body 1, and polluted outside air is sucked through the suction nozzle 2 by air sucking force generated by the air sucking device.

In this case, the cleaner body 1 includes a main controller for controlling the abovementioned air sucking device and the cleaner, and a dust collector receiving groove for receiving a dust collector 5 separating impurities from the polluted air sucked through the suction nozzle 2, and collecting the impurities.

A wheel 8 is provided on both sides at a lower part of the cleaner body 1, and an outlet 8*a* is provided at the wheel 8 for discharging clean air separated from the impurities in the dust collector.

Between the cleaner body 1 and the suction nozzle 2, a coupling pipe 3 is provided, the coupling pipe 3 including a sucking hose 3*a* made of a flexible material, a handle 3*b*, and an extended pipe 3*c*, for communicating the cleaner body 1 with the suction nozzle 2.

When power is applied the vacuum cleaner structured as aforementioned, and an operation of the vacuum cleaner is started, by the air sucking force generated by the air sucking device in the cleaner body 1, the polluted outside air is passed through the suction nozzle 2 and the coupling pipe 3, and flowed into the dust collector disposed in the cleaner body.

The impurities such as dust contained in the polluted air are separated from the dust collector 5, and only cleaned air is discharged to the outside through the outlet 8*a*, such that the interior cleaning is performed.

In the vacuum cleaner configured and operated as abovementioned, when a predetermined time is passed, and the dust collector is filled with impurities, a user needs to separate the dust collector from the cleaner body 1 to empty, and mount the dust collector back into the dust collector receiving groove of the cleaner body.

However, in the vacuum cleaner with the dust collector 5 detachably provided as abovementioned, air is prevented from leaking during suction in the middle of the operation of the vacuum cleaner and the air sucking device is prevented from being overloaded when airtightness between the dust collecting assembly and the cleaner body is maintained, and the dust collecting efficiency is increased when the impurities collected at a lower part of the dust collector are prevented from being risen to an upper part of the dust collector.

Therefore, development of a vacuum cleaner is requested, the vacuum cleaner having a structure wherein airtightness between the dust collector and the cleaner body is maintained, the impurities are prevented from being risen to the upper part thereof in a process of collecting the impurities, the dust collector is easily mounted, and discharging collected impurities and cleaning the inside of the dust collector are both easy.

SUMMARY OF THE INVENTION

Accordingly, the present invention is directed to a vacuum cleaner that substantially obviates one or more problems due to limitations and disadvantages of the related art.

An object of the present invention is to provide a vacuum cleaner for securing airtightness between a dust collecting assembly and a cleaner body, and enabling to attach and detach the dust collecting assembly.

Another object of the present invention is to provide a vacuum cleaner having a filtering device of which cleaning and exchanging are easy and a dust collecting assembly of which attaching and detaching are easy.

Another object of the present invention is to provide a vacuum cleaner having a structure that impurities collected in the dust collecting assembly are easily discharged, and cleaning the inside thereof is easy.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a vacuum cleaner includes a suction nozzle for sucking polluted air containing impurities by operation of a motor; a dust collecting assembly including: a dust collecting container having a dust collecting space for collecting impurities therein and having an opened top; a top lid for opening and closing the top of the dust collecting container; an inlet for sucking the polluted air to the inside of the dust collecting container; a filtering device provided in the dust collecting container for filtering impurities such as dust; a separation plate for preventing the impurities collected in a lower part of the dust collecting container from being risen by air flow; and an outlet for exhausting clean air separated from the impurities to the outside of the dust collecting container; and a cleaner body including: a dust collecting assembly receiving recess for detachably receiving the dust collecting assembly; a polluted air outlet provided at the dust collecting assembly receiving recess communicating with the inlet of the dust collecting assembly for discharging polluted air sucked through the suction nozzle; a clean air inlet provided on an inner wall of the dust collecting assembly receiving recess to face direction of mounting the dust collecting assembly and communicating with the outlet of the dust collecting assembly; and a clean air conduit including a fan provided therein and rotated by the motor, wherein a first end of the clean air conduit is coupled to the clean air inlet and a second end of the clean air conduit has a clean air outlet for exhausting the clean air to the outside of the vacuum cleaner.

In this case, the top lid is detachably provided at the top of the dust collecting container. The filtering device is detachably coupled to the top lid.

The top lid includes a pass through hole perpendicularly bored such that the filtering device is inserted and withdrawn from the upper side of the top lid.

The filtering device is coupled on the top lid by means of a projector formed at a top end of the filtering device and a coupling lever provided on a top surface of the top lid for fixing the projector.

The filtering device includes a filter formed in a cylindrical form for filtering impurities; and a filter supporter for supporting the filter.

The dust collecting assembly is attached or detached from a front of the cleaner body. The outlet of the dust collecting assembly is formed at a lower part of a rear side of the dust collecting container and the clean air inlet is formed at a lower part of a rear inner wall of the dust collecting assembly receiving recess.

The dust collecting assembly further includes an inner flow tube having a first end communicating with the outlet of the dust collecting assembly and a second end communicating with the filtering device, thereby guiding clean air from the filtering device to the outside of the dust collecting container.

The inner flow tube of the dust collecting assembly includes: a first flow tube having a first end communicating with the outlet of the dust collecting assembly and a second end extended toward a center of the dust collecting container; and a second flow tube having a first end connected to the second end of the first flow tube, and a second end extended upward to a lower end of the filtering device.

A coupling part of the first flow tube and the second flow tube is curved or inclined so as to minimize flow resistance of the clean air discharged from the dust collecting space.

The inner flow tube includes a flow tube cover provided at the second end thereof so as to prevent the impurities from being flowed into the inside thereof.

The inlet of the dust collecting assembly is provided in a tangential direction at a predetermined location on a side of the dust collecting container such that the polluted air sucked into the inner space of the dust collecting container spirally flows.

The dust collecting assembly further includes an anti rotation plate having a predetermined height and radially provided in the dust collecting container for preventing the impurities from being rotated by spiral air flow.

Meanwhile, a bottom part of the dust collecting container is openable.

The dust collecting container includes: a top container having a top being openably and closably mounted thereon; a bottom lid connected to a first side of the lower end of the top container for opening and closing a bottom of the top container; and a lid fixing device provided at a second side of the lower end of the top container for selectively fixing the bottom lid.

The separation plate is opened by rotation when the impurities collected in the dust collecting container are exhausted.

The separation plate includes two semicircular plates provided in the dust collecting container so that the semicircular plates rotate in an upper direction of the dust collecting container.

The cleaner body further includes a packing member provided between the clean air inlet and the outlet of the dust collecting assembly for maintaining airtightness between the clean air inlet and the outlet of the dust collecting assembly.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
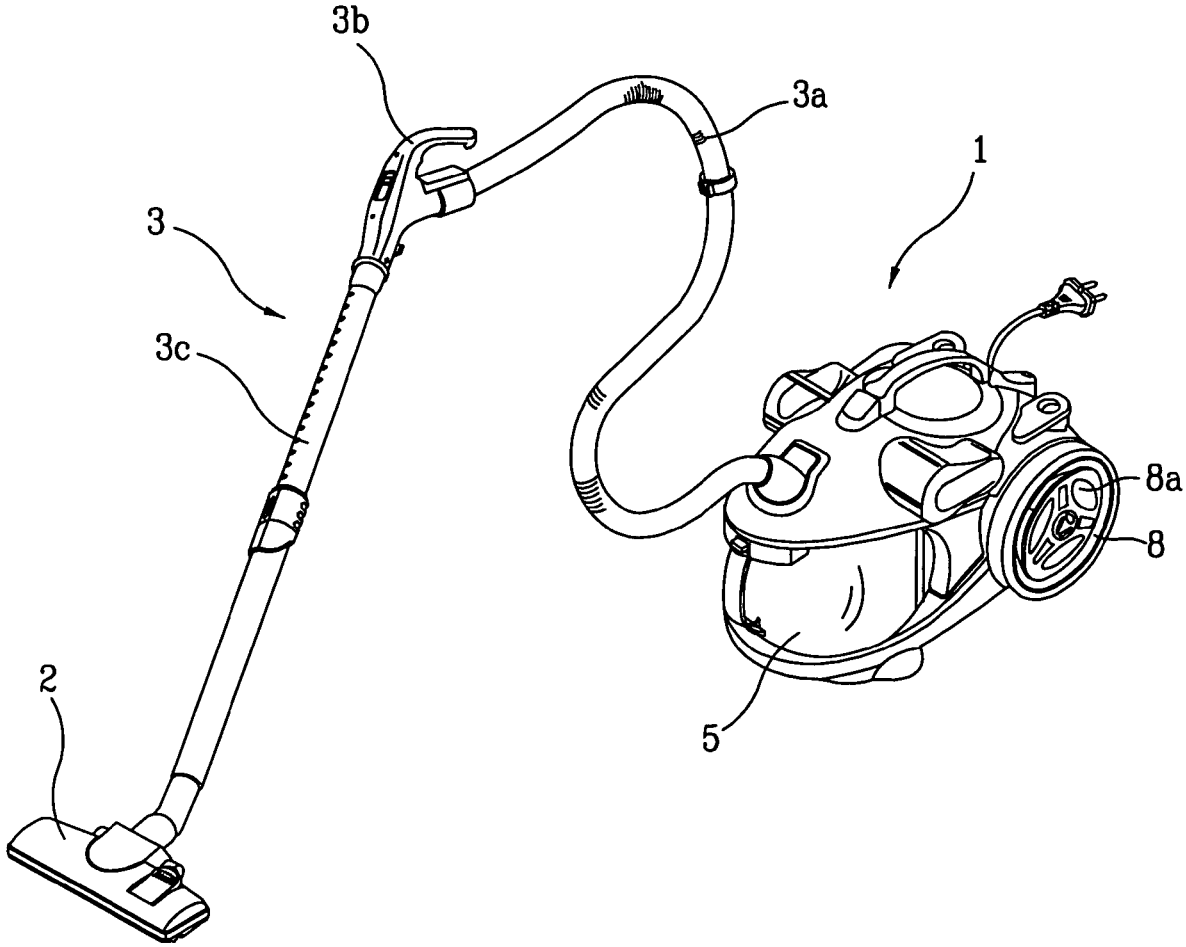
FIG. 1 illustrates a perspective view showing a related art vacuum cleaner.
Figure 2:
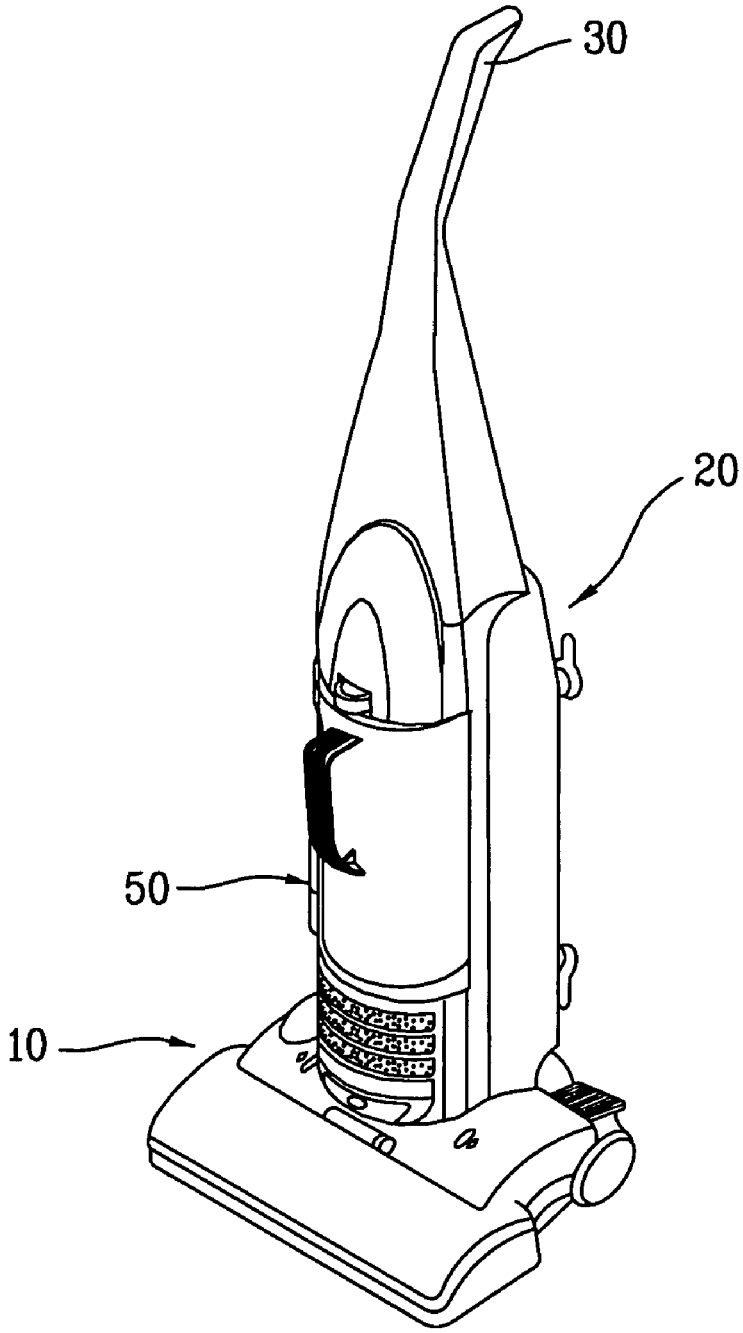
FIG. 2 illustrates a perspective view showing a vacuum cleaner in accordance with a preferred embodiment of the present invention.
Figure 3:
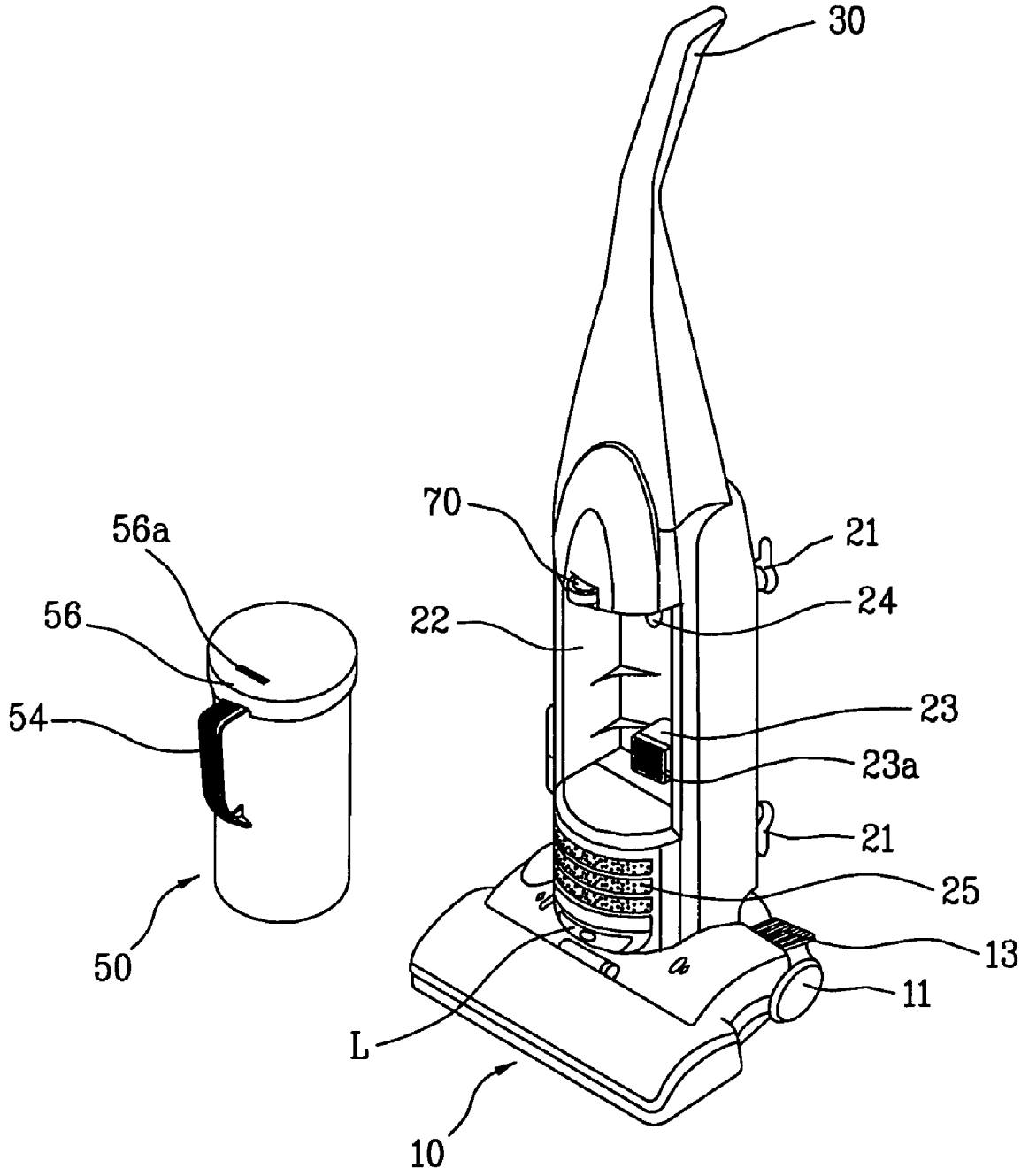
FIG. 3 illustrates a perspective view showing a dust collecting assembly being separated from a cleaner body, the dust collecting assembly provided in a vacuum cleaner in accordance with the present invention.
Figure 4:
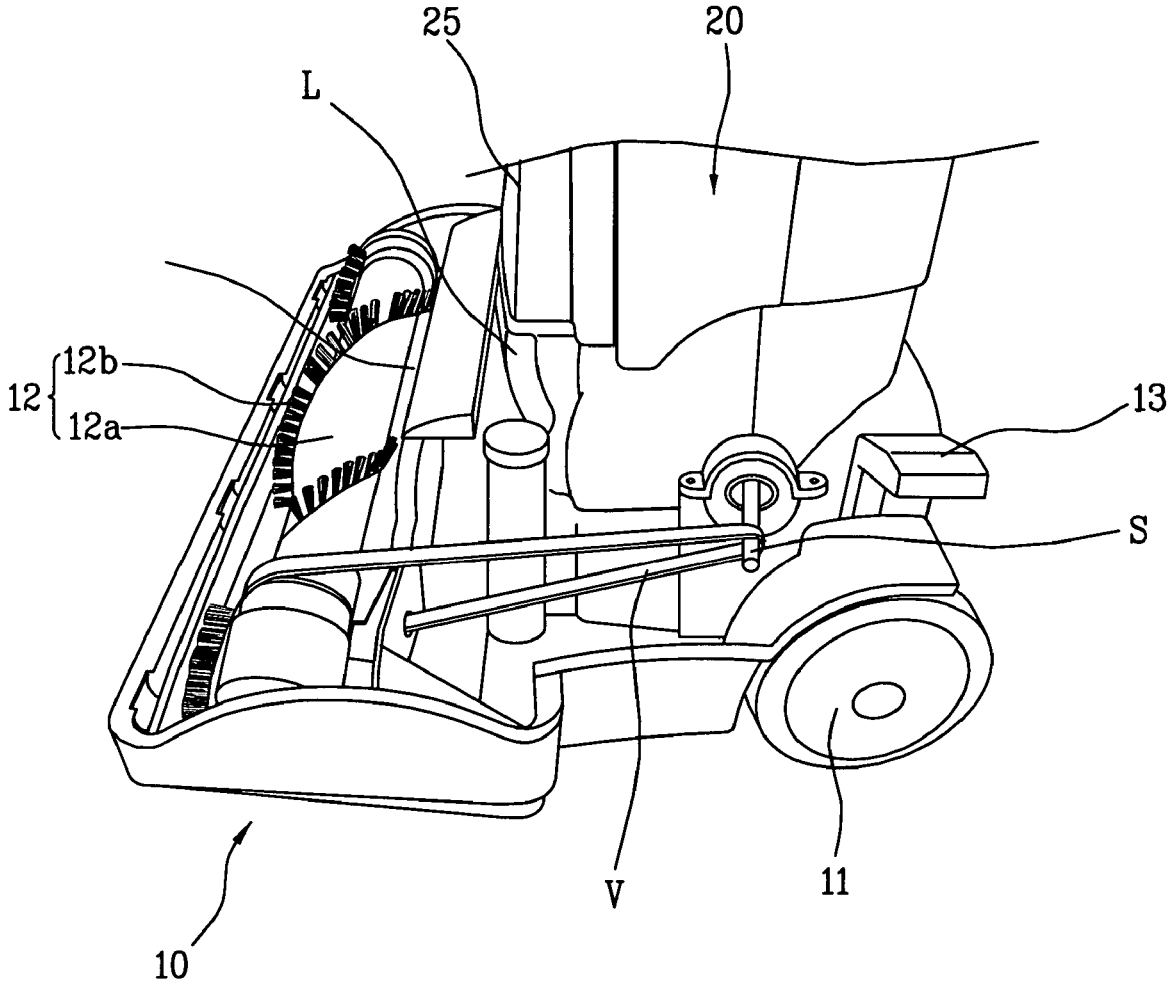
FIG. 4 illustrates a perspective view showing an inside structure of a suction nozzle provided in a vacuum cleaner in accordance with the present invention.
Figure 5:
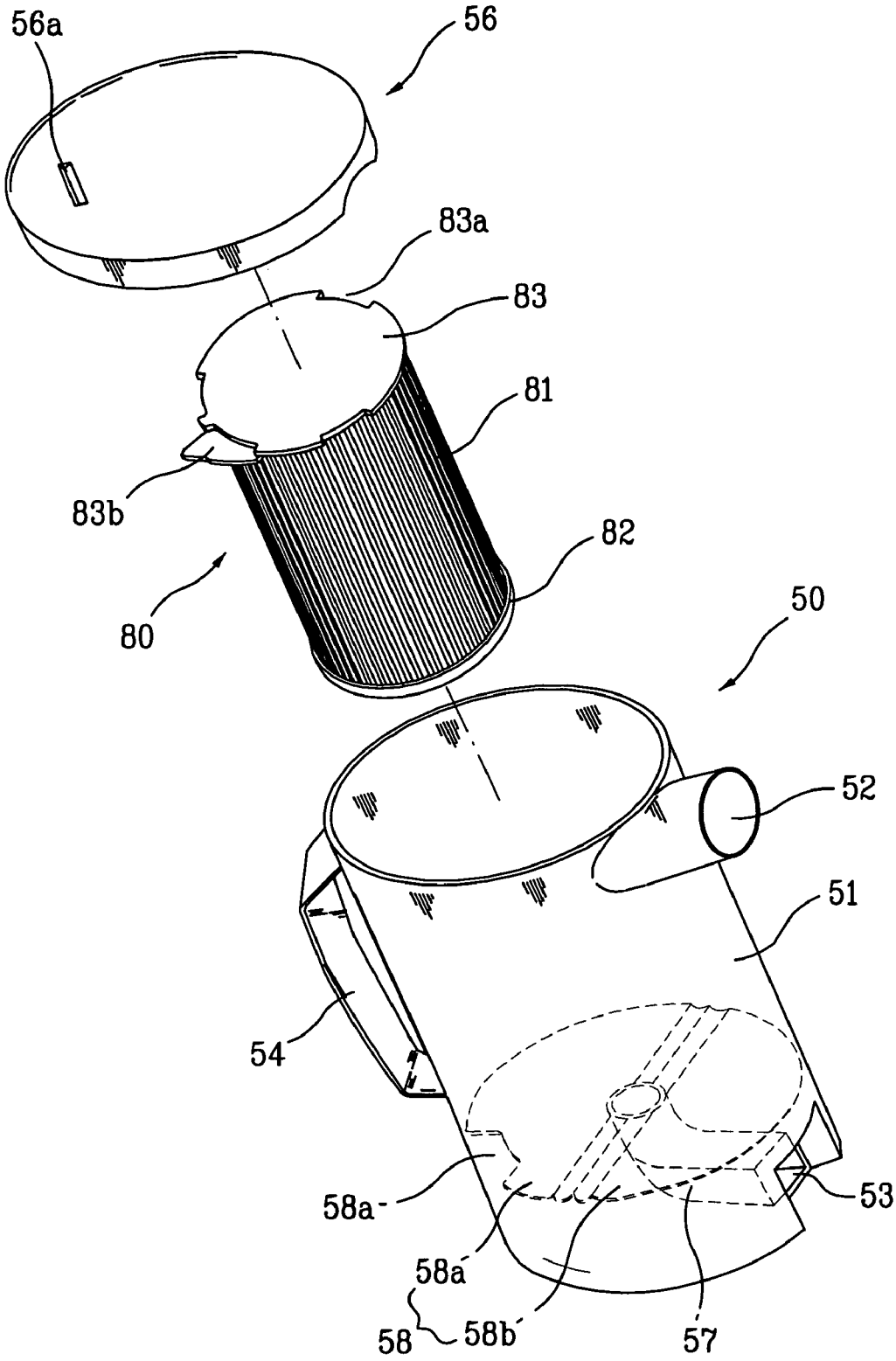
FIG. 5 illustrates a perspective view showing a first embodiment of a dust collecting assembly provided in a vacuum cleaner in accordance with the present invention.
Figure 6:
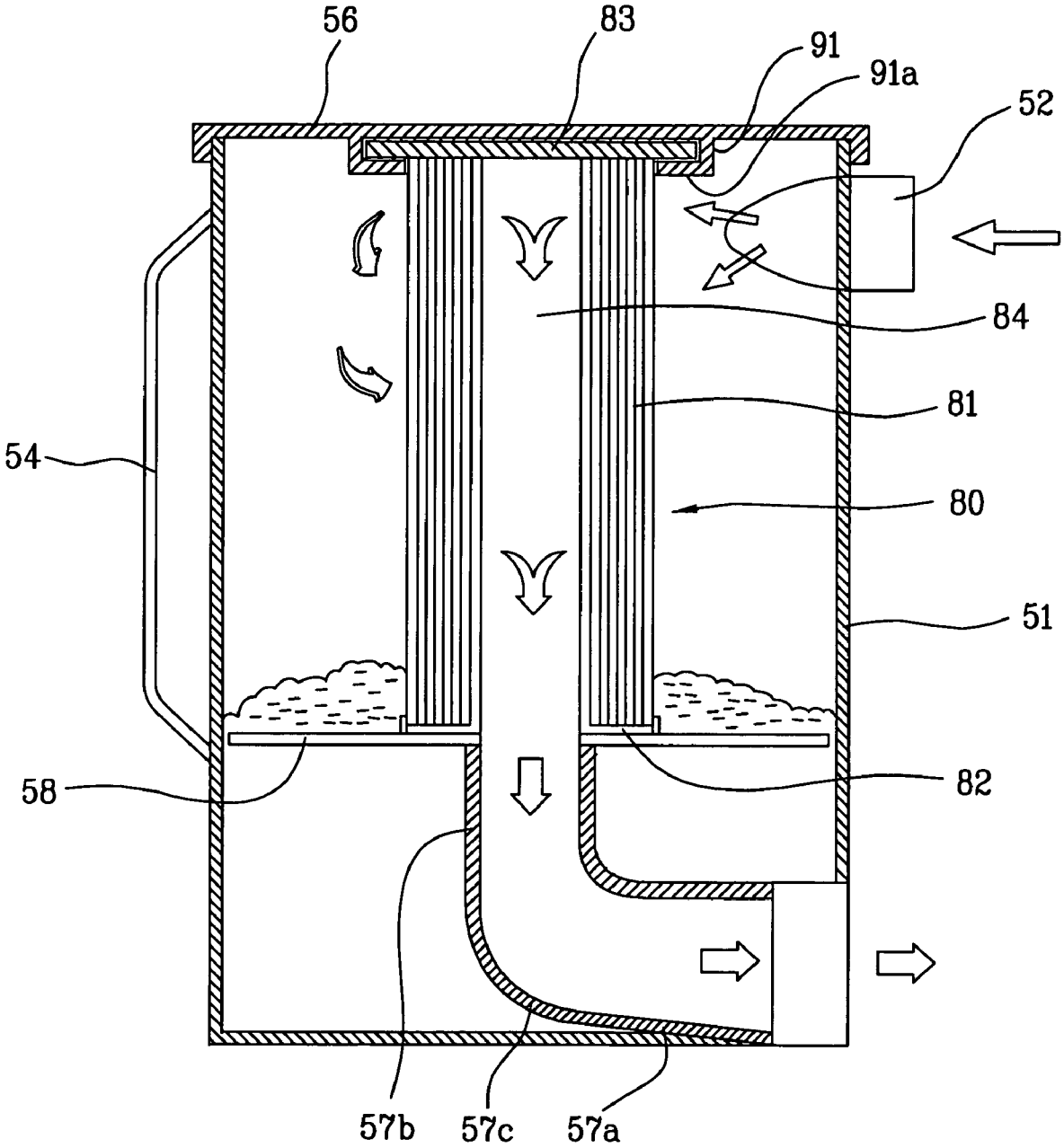
FIG. 6 illustrates a cross-sectional view showing the dust collecting assembly of FIG. 5.
Figure 7:
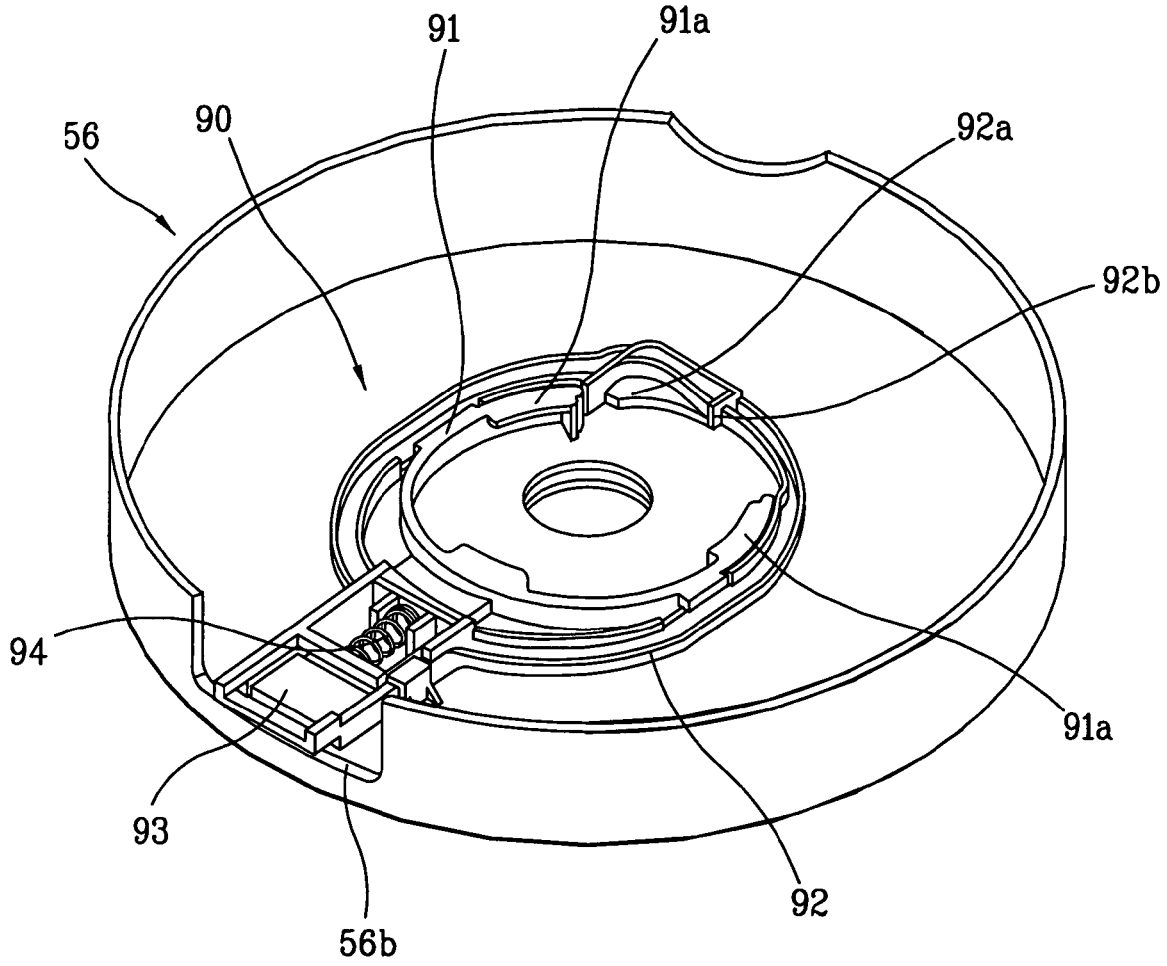
FIG. 7 illustrates a lower surface of the top lid of the dust collecting assembly of FIG. 5.

Referring to FIGS. 2 to 4, a vacuum cleaner in accordance with the present invention includes a suction nozzle 10 moving along a floor and sucking air containing impurities, a cleaner body 20 coupled with the head, and a handle 30 coupled with the cleaner body.

The suction nozzle 10 includes wheels 11 at a lower part thereof, moves along the floor in a state of being close thereto, and sucks polluted air containing impurities from outside through a main inlet (not shown) provided at a lower part thereof.

In this case, it is desirable that a width of the suction nozzle 10 is 12 to 16 inches, and an agitator 12 is provided on an inner surface of the main inlet of the suction nozzle. The agitator 12 is for separating the impurities such as dust stuck on the floor and sucking the impurities along with outside air. The agitator 12 includes a rotation axis 12*a* formed in a cylindrical form and having both ends supported by both sides of the main inlet, and a rotation brush 12*b* provided on an outer circumferential surface of the rotation axis. In this case, it is desirable that the rotation brush 12*b* is provided in a spiral direction on the outer circumferential surface of the rotation axis 12*a*.

The cleaner body 20 is rotatably provided at an upper part of the suction nozzle 10 to be rotatable in a predetermined range in a back and forth direction, and a rotation adjusting lever 13 is provided at an upper rear surface of the suction nozzle 10 for adjusting rotation of the cleaner body 20.

Owing to the structure abovementioned, a user can adjust the cleaner body 20 to a desired angle by pushing or pulling the handle 30 while stepping on the rotation adjusting lever 13 according to the height of the user or a location to be cleaned.

An electric wire fixing member 21, on which an electric wire is wound, is provided on a rear surface of the cleaner body 20. In more detail, the electric wire fixing member 21 is formed in a hook form to be symmetrical to each other in up and down direction or on right and left direction on a rear surface of the cleaner body.

In the cleaner body 20, an air sucking device (not shown) having a motor is provided for generating air sucking force, and the polluted outside air is sucked through the main inlet of the suction nozzle 10 by an operation of the air sucking device.

In this case, it is desirable that the rotating axis (S) of the motor is connected to the rotating axis 12*a* of the agitator of the suction nozzle by means of a belt, such that the motor generates sucking force for sucking the polluted air and makes the rotation brush 12*b* of the agitator and the rotating axis to rotate. It is also desirable that a sensor, particularly a temperature sensor (not shown) is provided in the cleaner body 20 for sensing overload of the air sucking device so as to automatically cut off power when the air sucking device is overheated more than a predetermined temperature. The air sucking device may be provided in the suction nozzle 10. On a lower front surface of the cleaner body 20, a lamp (L) is provided for lightening a front of the vacuum cleaner.

In front portion of the cleaner body 20, a dust collecting assembly receiving recess 22 receiving the dust collecting assembly 50 is formed, the dust collecting assembly 50 separating impurities contained in the polluted air from the polluted air, and collecting.

The dust collecting assembly groove 22 includes a receiving space hollowed rearward so as to have a space for receiving the dust collecting assembly 50. In other words, the dust collecting assembly receiving recess 22 is sunken on the front surface of the cleaner body to be correspondent to an exterior shape of the dust collecting assembly 50 for receiving the dust collecting assembly 50.

The dust collecting assembly 50 collects the impurities separated from the polluted air sucked through the main inlet of the suction nozzle 10, and exhausts cleaned air.

For attaching and detaching the dust collecting assembly 50, a detaching device 70 is provided at an upper part of the dust collecting assembly receiving recess 22, the detaching device 70 having restoring force by an elastic member, and a groove 56*a* is provided on a upper surface of the dust collecting assembly 50, for engaging with the detaching device 70.

The detaching device 70 and the groove 56*a* structured as abovementioned fix the dust collecting assembly 50 on the cleaner body 20 for installation of the dust collecting assembly 50, and release the dust collecting assembly 50 for separation of the dust collecting assembly 50.

In other words, for separation of the dust collecting assembly 50, a user separates the dust collecting assembly 10 from the cleaner body 20 by pressing the detaching device 70 and releasing the detaching device from the groove 56*a*, and for installation of the dust collecting assembly, the user fixes the dust collecting assembly 50 on the cleaner body 20 by pushing the dust collecting assembly from the front of the cleaner body into the dust collecting assembly receiving recess 22 and making the detaching device 70 to engage with the groove 56*a* by means of the restoring force.

The dust collecting assembly 50 structured as abovementioned collects the impurities by a cyclone principle, or by using a filtering device. As a method for separating the impurities in the dust collecting assembly 50, both the cyclone principle and the filtering device can be adopted at the same time.

The dust collecting assembly configured to collect the impurities by using the cyclone principle makes the air flow in a cyclonic movement, the air drawn into the dust collecting assembly, and the dust collecting assembly configured to separate the impurities by the method for separating impurities by using a filtering device has the filtering device in the dust collecting assembly so as to remove the impurities from the polluted air and exhaust clean air to the outside thereof. At the dust collecting assembly configured to adopt both of the cyclone principle and the filtering device includes both structures abovementioned.

Hereinafter, referring to FIG. 3 to 7, a first embodiment of the dust collecting assembly structured to separate the impurities such as dust by using the cyclone principle firstly, and then separate fine dust by using the filtering device secondly, and the vacuum cleaner with the dust collecting assembly will be described.

Referring to FIG. 3 to 7, the dust collecting assembly 50 includes a dust collecting container 51 formed in a perpendicular form, having a center axis perpendicularly provided at the dust collecting assembly receiving recess 22, having a dust collecting space formed in a cylindrical form for separating and collecting impurities such as dust by using the cyclone principle therein, and having an open top thereof, an inlet 52 and an outlet 53 provided at a predetermined location on a side of the dust collecting container, a dust collecting container handle 54 provided on a front outer wall of the dust collecting container 51, and a top lid 56 detachably provided at an upper part of the dust collecting container 51 for opening and closing the open top of the dust collecting container, and having a groove 56*a* over which the detaching device 70 is engaged with.

In the present invention, the outlet 53 of the dust collecting assembly exhausts clean air to rear side thereof, and corresponding to the outlet of the dust collecting assembly, a clean air inlet 23 being connected with the outlet 53 of the dust collecting assembly is provided on a rear inner wall of the dust collecting assembly receiving recess 22. In other words, the clean air inlet 23 is provided on the rear inner wall of the dust collecting assembly receiving recess 22 to face the front thereof.

The cleaner body 20 includes a polluted air conduit (not shown) guiding the polluted air sucked through the main inlet of the suction nozzle 10 to the inlet of the dust collecting assembly 52 and having a polluted air outlet connected to an end thereof to the inlet of the dust collecting assembly 52, and a clean air conduit (not shown) including the clean air inlet 23 provided at a first end thereof and a clean air outlet 25 provided at a second end thereof for exhausting the clean air to the outside of the vacuum cleaner.

The polluted air conduit is provided to pass through the inside of the cleaner body 20, or to be exposed outside of the cleaner body 20. In this case, when the polluted air conduit is provided to be exposed outside of the cleaner body 20, the polluted air conduit is made of an elastic material and a predetermined portion of the conduit is detachably connected to the cleaner body 20 such that the user can clean a corner by using the polluted air conduit. When the corner is cleaned as abovementioned, it is desirable that an accessory coupled to the polluted air conduit is provided on a rear surface or on a side of the cleaner body.

Meanwhile, a fan (not shown) is provided at the air sucking device such as the motor. In the present invention, it is desirable that the fan is provided at the clean air conduit for forcing air flow in the vacuum cleaner.

Owing to the dust collecting assembly 50 and the cleaner body 20 structured as abovementioned, when the dust collecting assembly 50 is fit in the dust collecting assembly receiving recess 22 of the cleaner body, the clean air inlet 23 and the outlet 53 of the dust collecting assembly are more tightly connected by pushing force of the user. Furthermore, when carelessness or an inexperienced manipulation of the user caused a gap between the clean air inlet 23 and the outlet 53 of the dust collecting assembly, and airtightness is not maintained there, because the air is sucked from the clean air inlet 23 by the operation of the air sucking device, the dust collecting assembly is tightly adhered to the rear side of the dust collecting assembly receiving recess 22 by air suction force, thereby coupling the clean air inlet 23 with the outlet 53 of the dust collecting assembly 53 without any gap therebetween. Therefore, the airtighteness between the dust collecting assembly 50 and the cleaner body 20 is maintained.

Owing to the abovementioned principle, maintaining airtightness between the dust collecting assembly and the cleaner body is enabled by providing the clean air inlet 23 of the cleaner body on the inner wall of the dust collecting assembly receiving recess 22 such that the clean air inlet 23 of the cleaner body opposes to a direction of mounting the dust collecting assembly 50.

It is desirable that a packing member (23*a*) is provided between the clean air inlet 22 and the outlet 53 of the dust collecting assembly for maintaining airtightness therebetween, so as to secure the airtightness between the dust collecting assembly 50 and the cleaner body 20.

In more detail, the packing member 23*a* is provided at a front edge of the clean air inlet 23 and formed in a mesh form such that large impurities are prevented from being drawn into the clean air inlet 23. In other words, when the dust collecting assembly 50 is installed at the cleaner body 20, airtightness between the clean air inlet 23 and the outlet 53 of the dust collecting assembly is maintained by closely adhering the packing member 60 provided at the clean air inlet 23 to the outlet 53 of the dust collecting assembly. In this case, it is desirable that the packing member 23*a* is made of a material such as rubber or silicon having elasticity.

The inlet 52 of the dust collecting assembly is provided at a predetermined location of the upper part of the dust collecting container in a tangential direction such that the polluted air drawn into the dust collecting space is spiraled in the dust collecting container 51.

In more detail, the inlet 52 of the dust collecting assembly is provided in the tangential direction on the upper side of the dust collecting container 51, and the polluted air guided by the polluted air conduit flows spirally in the dust collecting container 51 and is separated into the impurities and clean air, by the difference of centrifugal fore between impurities and clean air.

In this case, the inlet 52 of the dust collecting assembly is projected to the outside so as to be inserted into and coupled to the polluted air outlet, and the inlet 52 of the dust collecting assembly is inclined to a predetermined degree such that the air flows from the upper part to the lower part thereof.

The dust collecting assembly 50 further includes a filtering device 80 detachably coupled to the top lid 56 and filtering impurities such as fine dust.

The filtering device 80 is coupled to the top lid 56 so that the filtering device 80 is detached from the dust collecting container 51 along with the top lid 56 when the top lid 56 is opened.

In more detail, the filtering device 80 includes a filter 81 formed in a cylindrical form and filtering the impurities, and filter supporter 82, 83 for supporting the filter 81.

The filter supporter 82, 83 includes a bottom end supporter 82 supporting a lower end of the filter 81 for maintaining a circular form thereof, and a top end supporter 83 supporting a top end of the filter. The filter supporter, of course, may be formed in a cylindrical form (not shown) with a plurality of pass through holes so as to support an inner surface of the filter 81. The filtering device 80 further includes a supplementary filter (not shown) provided on an inside of the filter 81 for filtering fine dust.

In this case, it is desirable that the filter 81 has a plurality of blocks longitudinally provided on an outer circumferential surface at predetermined intervals along a circumferential direction, and formed in a pleated form, such that an area being in contact with flowing air is maximized.

The filter includes more than a predetermined strength with regard to a strong flow of air, and made of a material that maintains the form during washing. It is also desirable that the filter supporter is made of synthetic resins, which is washable.

A clean air guiding passage 84 is formed in the filtering device 80 through which the air passed through the filters to be cleaned flows.

The top end supporter 83 of the filtering device is formed to be larger than the bottom end supporter 82, and the top end supporter 83 is fixed to the top lid by a filter fixing device 90 incorporated integrally into a lower surface of the top lid 56.

Meanwhile, for fixing the filtering device 80 to the top lid 56, a plurality of grooves 83*a* having a predetermined depth and width on an outer circumferential surface of the top supporter 83, and a push projection 83*b* provided between two grooves of the grooves.

The filter fixing device 90 includes a filter fixing member 91 formed in cylindrical form and having a coupling projection 91*a* projected to the inside thereof such that the filtering device 80 passes through the groove 83*a* of the top end supporter when the filtering device is mounted on the top lid 56, a shifting member 92 formed in a cylindrical form and being shifted by the press projection to one side, and a filter coupling confirmer 93 coupled to the shifting member 92 for moving along with the shifting member 92 and preventing the top lid 56 from being coupled to the dust collecting container 51 when the filtering device is not coupled to the top lid 56.

The shifting member 92 includes an inserting groove 92*a* for receiving the push projection 83*b* of the top end supporter, and a fixing end 92*b* projected to the inside thereof for fixing the push projection 83*b* at a predetermined location of the filtering device.

The filter coupling confirmer 93 is moved to the same direction as the shifting direction of the shifting member 92, and is projected outside through a hole 56*b* provided on a side of the top lid 56 when the filtering device 80 is separated from the top lid 56. For this, an elastic member such as a spring is provided inside of the filter coupling confirmer, and the spring 94 applies pressure to an inner surface of the filter coupling confirmer 93 so as to project outside through the hole 56*b* formed on the side of the top lid 56 by restoring force of the spring when the filtering device 80 is separated from the filter fixing device 90 of the top lid 56. In the present invention, because the dust collecting container 51 is coupled to the top lid in a method of inserting an upper end of the dust collecting container 51 into the inside of the top lid 56, it is impossible that the top lid 56 shuts tightly the dust collecting container 51 when the filter coupling confirmer 93 is projected to a side of the top lid 56.

A process of attaching and detaching the filtering device 80 to the filter fixing device of the top lid 56 is described as follows.

First, when the filtering device 80 is separated from the top lid 56, the filter coupling confirmer 93 is projected to the side of the top lid 56 by the restoring force of the spring 94. Accordingly, as mentioned above, it is impossible that the top lid 56 shuts tightly the dust collecting container 51, and, at this time, since the top lid 56 and a top surface of the dust collecting assembly receiving recess 22 interfere with one another, the dust collecting assembly is not mounted on the cleaner body 20.

Next, for mounting the filtering device to the top lid 56, if the filtering device 80 is rotated such that the push projection 83*b* faces the fixing end 92*b* when the groove 83*a* of the top end supporter and the push projection 83*b* correspond to the coupling projection 91*a* of the filter fixing member and the inserting groove 92*a* of the shifting member respectively, the push projection applies pressure to the inserting groove 92*a* so as to move the shifting member 92 to an opposite direction of the filter coupling confirmer 93. If the filtering device is rotated more, the push projection 83*b* is caught by the fixing end 92*b*, and the top end supporter 83 is fixed by the coupling projection. Therefore, the filter coupling confirmer 93 is moved in the same direction of the shifting member and positioned within the side of the top lid such that the top lid 56 is able to tightly shut the dust collecting container 51 without interference and the dust collecting assembly 50 is completely mounted on the cleaner body 20 without interference.

For exhausting the clean air cleaned by the cyclone principle and the filtering device as abovementioned to the outside of the dust collecting space in the dust collecting container, an inner flow tube 57 is provided in the dust collecting assembly 50, the inner flow tube 57 having a first end communicating with the outlet 53 of the dust collecting assembly and a second end being provided to a predetermined location, and more particularly, to the lower end of the filtering device 80 so as to communicate with the clean air guiding passage 84 of the filtering device, and forming a passage for guiding the clean air from the dust collecting space to the outside of dust collecting assembly 50.

In more detail, it is desirable that the inlet of the dust collecting assembly 53 is provided on a position hollowed to a predetermined depth at a lower portion of the dust collecting container 51, and the inner flow tube 57 includes a first flow tub 57*a* having a first end coupled to the outlet of the dust collecting assembly 53 and a second end horizontally extended to the center of the dust collecting container, and a second flow tube 57*b* having a first end connected to the second end of the first flow tube 57*a*, and a second end extended upward to the lower end of the filtering device 80 for communicating with the clean air guiding passage 84 of the filtering device, and the connecting part 57*c* of the first flow tube 57*a* and the second flow tube 57*b* is curved or inclined for minimizing flow resistance of the clean air discharged from the dust collecting space.

The outlet 53 of the dust collecting assembly is formed on a rear lower side of the dust collecting container 51, or projected at a position to a predetermined height on a rear lower side of the dust collecting container 51.

Owing to the construction abovementioned, the polluted air drawn into the dust collecting assembly 50 is cleaned firstly by the cyclone principle which separates large and heavy impurities, and cleaned secondly by passing through the filtering device 80 which filters the fine dust particles, and then discharged to the outside through the clean air guiding passage of the filtering device 80, the inner flow tube 57*a*, and the clean air outlet of the cleaner body having the fan.

It is obvious that the microscopic dust is additionally filtered before the air is discharged to outside of the vacuum cleaner by providing a third filter (not shown) at a predetermined location of the clean air discharging conduit. The filters may include HEPA filters.

However, since the dust collecting assembly 50 with the abovementioned structure separates and collects impurities such as dust according to the cyclone principle, there is a problem that the impurities such as dust collected at a lower part of the dust collecting container 51 is risen by spiraled air in the dust collecting assembly, and thereby lowering dust collecting efficiency.

Therefore, the dust collecting assembly 50 provided in the vacuum cleaner in accordance with the present invention further includes a separation plate 58 for separating the dust collecting space in the dust collecting container into an upper space and a lower space. In more detail, the separation plate 58 is provided in the vicinity of the filtering device 80 and the inner flow tube 57 such that the impurities separated from the upper space of the dust collecting container 51 is moved to the lower space of the dust collecting container, and the impurities collected at the lower space of the dust collecting container is prevented from being interfered by the air flow. In other words, at least one hole 58*a*, through which dust particles pass, is provided on an rim of the separation plate 58 such that relatively large dust particles are moved to the lower part of the separation plate 58, the large dust particles among the impurities included in the polluted air drawn through the inlet of the dust collecting assembly 50.

The separation plate 58 is provided to be opened or closed by rotation at a lower part of the filtering device 80 for discharging the impurities collected in the lower part of the separation plate 58 when the dust collecting assembly 51 is upside down for discharging the dust collecting assembly 50.

For this, the separation plate 58 may include a structure having two semicircular plates 58*b* and 58*c* rotated upwardly, or in a structure of a round form or an elliptic form (not shown) with a center of gravity being eccentric about the rotation axis.

The separation plate 58 separating the inside of the dust collecting container 51 increases dust collecting efficiency by preventing the impurities such as dust collected at the lower part of the dust collecting container 51 from being risen or rotated by flowing air, particularly spiraled air in the dust collecting assembly.

Next, the referring to FIG. 8 to FIG. 9, a second embodiment of the dust collecting assembly provided at the vacuum cleaner in accordance with the present invention will be described.

Figure 8:
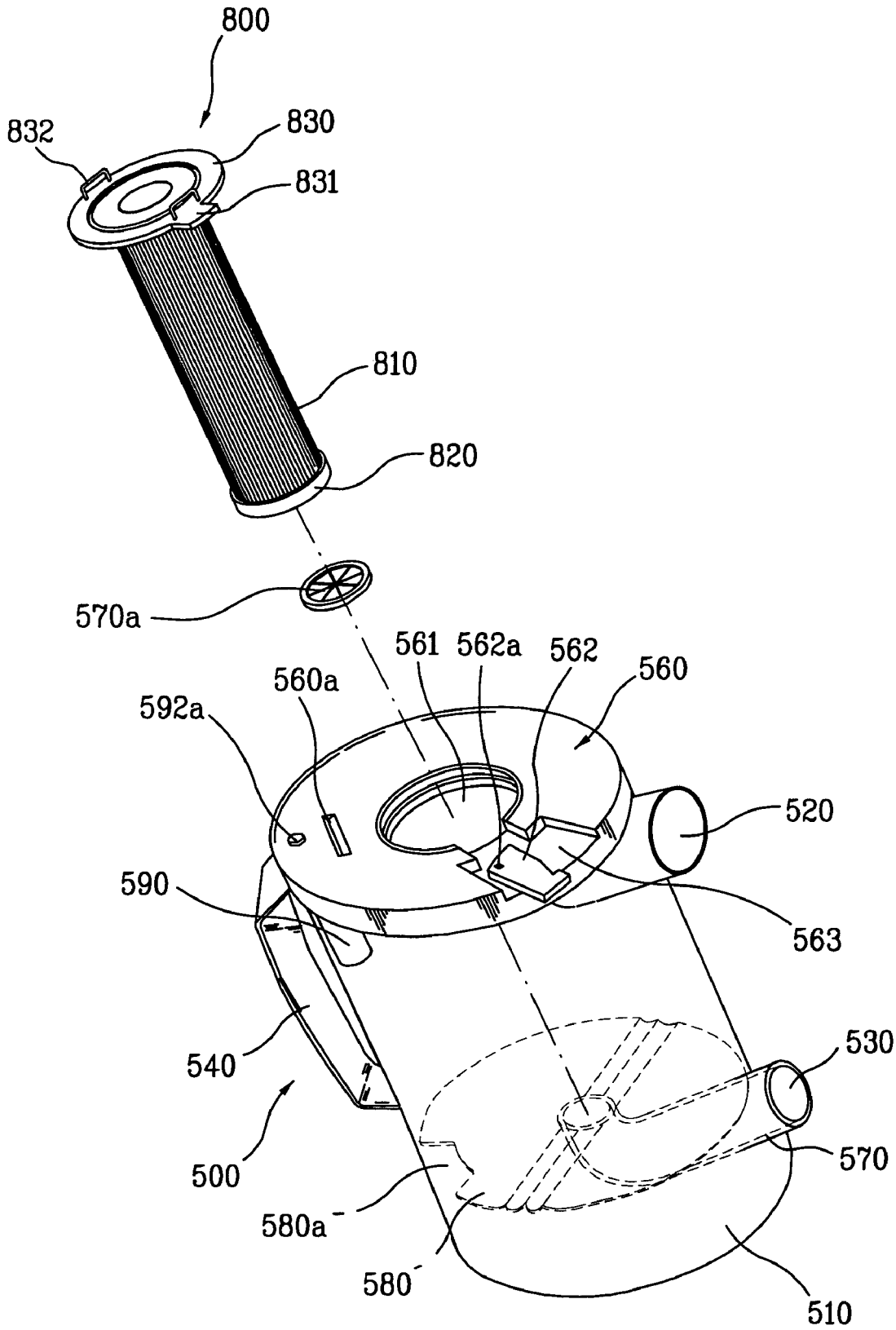
FIG. 8 illustrates a perspective view showing a second embodiment of a dust collecting assembly provided in a vacuum cleaner in accordance with the present invention.
Figure 9:
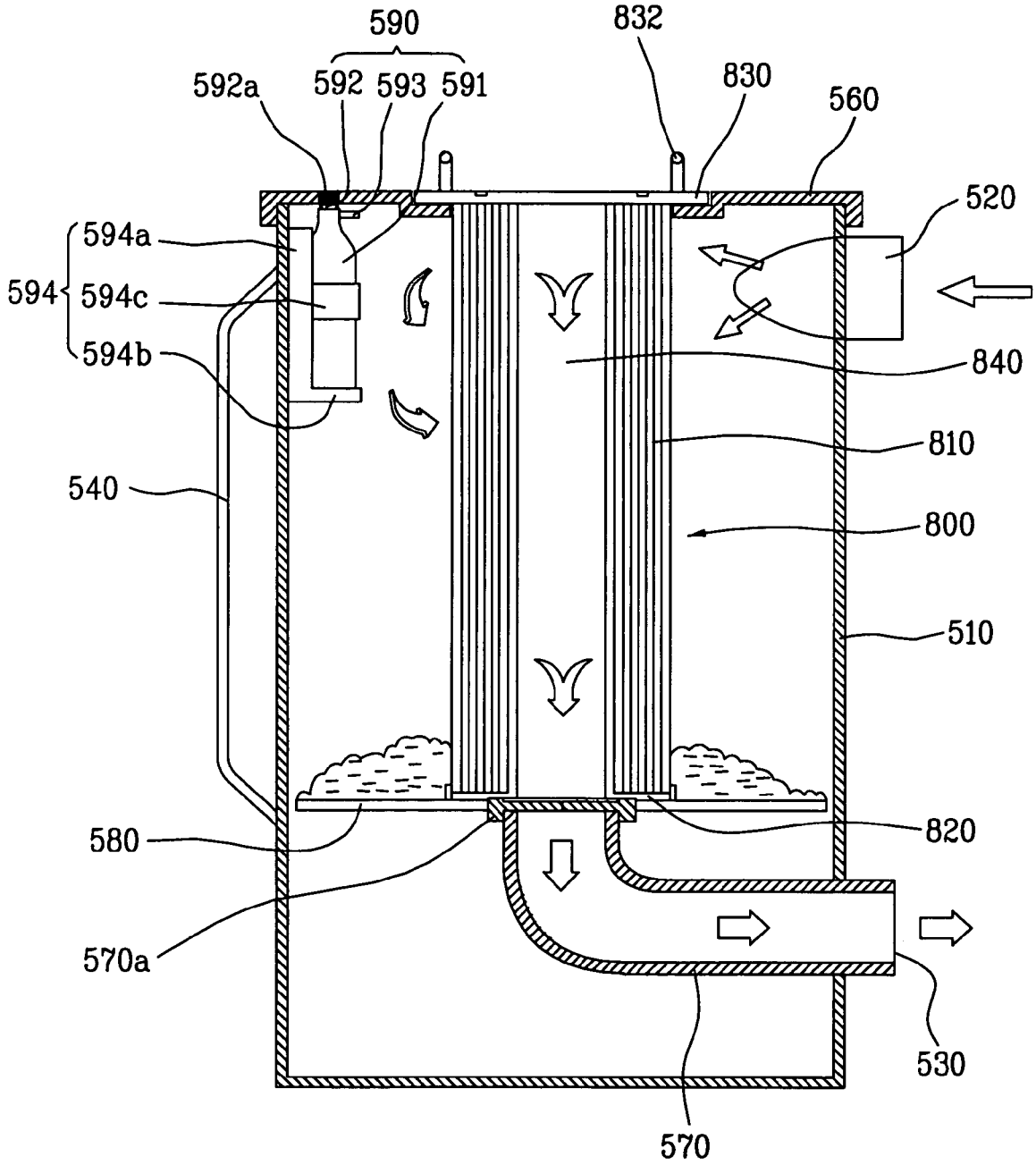
FIG. 9 illustrates the dust collecting assembly of FIG. 8.

Referring to FIG. 8 to FIG. 9, the dust collecting assembly 500 in accordance with the second embodiment includes a dust collecting container 510 formed in a cylindrical form, having an opened top and having a dust collecting space for collecting the impurities therein, an inlet 520 provided on a rear upper side of the dust collecting container for sucking polluted air, an outlet 530 provided on a rear lower side of the dust collecting container, a dust collecting container handle 540 provided on a front outer wall of the dust collecting container, a top lid 560 for opening and closing the opened top of the dust collecting container 510, a filtering device 800 detachably coupled on the upper surface of the dust collecting container, an inner flow tube 570 for guiding clean air separated from the impurities in the filtering device to the outside of the dust collecting container, and a separation plate 580 for separating the dust collecting space of the dust collecting container 510 into an upper part and a lower part.

In describing the second embodiment of the dust collecting assembly, the same reference numbers will be used to refer to the same or like parts of the first embodiment, and detailed description for the same parts will be omitted.

In the dust collecting assembly in accordance with the second embodiment, a sprayer 590 is provided in the dust collecting container 510 for spraying an insecticide or an antistatic.

The sprayer 590 includes a sprayer body 591 formed in a round form, a spray button 592 provided at an upper part of the sprayer body 591, an operating button 592*a* provided at an upper part of the spray button 591 and projected over the top lid 560, and a spraying orifice 593 projected from the upper end of the sprayer body 591 to a side thereof.

The sprayer 590 uses a principle of a conventional sprayer and stores a spraying liquid is stored in the sprayer body 591. When a user presses an operating button 592*a* coupled to an upper part of the spray button and projected over the upper part of the top lid 560, the spray button 592 is pressed, and the spraying liquid in the sprayer body 591 rose along a passage (not shown) and then sprayed through the spraying orifice.

The sprayer body 591 stores a material such as an antistatic, and the insecticide or germicide or fragrance may be added thereto.

The sprayer 590 is fixed on the upper inner wall of the dust collecting container 510 by a sprayer mounting member 594. The sprayer mounting member 594 includes a side supporter 594*a* perpendicularly provided with a long length for supporting the side of the sprayer body 61, a bottom supporter 594*b* projected from a lower end of the side supporter 594*a* to a side and supporting the lower end of the sprayer body 591, and a couple of fixing member 594*c* projected from both sides in the middle of the side supporter 594*a* in a ring form for preventing the sprayer 590 from being escaped.

The bottom supporter 594*b* is shaped in a round plate form to be correspondent to a lower surface of the sprayer 590, and the fixing member 594*c* having elasticity is formed in a round form for covering the sprayer body 591 so as to fix the sprayer body 591. It is desirable that the bottom supporter 594*b* and the fixing member 594*c* are incorporated into the side supporter 594*a*.

The dust collecting assembly 530 discharging the clean air cleaned therein to the rear the dust collecting container 510 is projected rearward from the bottom side of the dust collecting container, and inserted into and coupled to the clean air inlet of the cleaner body 20.

Meanwhile, the filtering device 800 is not detachable directly from the bottom surface of the top lid 560, but inserted into and withdrawn from the top of the dust collecting assembly, i.e., from an upper side of the top lid 560 through the top lid.

In this case, the filtering device 800 includes a filter 810 formed in a cylindrical form, a filter supporter 820, 830 for supporting the filter 810, and a clean air guiding passage 840 formed in an inside of the filter 810.

The filter supporter includes a bottom end supporter 820 supporting a lower end of the filter 810 so as to maintain a circular form thereof, and a top end supporter 830 supporting a top end of the filter 810.

Except the top end supporter 830, the filter 810, the bottom end supporter 820, and the clean air guiding passage 840 are the same as in the first embodiment of the dust collecting assembly, and description of which will be omitted.

In the second embodiment, the top lid 560 for opening and closing the opened top of the dust collecting container 510 has a pass through hole 561 perpendicularly bored in the center thereof so as to insert and withdraw the filtering device 800 from the upper side of the top lid.

The pass through hole 561 is formed in a round form corresponding to the top end of the filtering device 800, and more particularly to the top end supporter 830, and the upper surface of the edge of the pass through hole 561 has a step such that the bottom surface of the edge of the top end supporter 830 is stably mounted.

For fixing the filtering device 800, a projector 831 is radially projected from the circumferential surface of the top end supporter 830, a coupling lever 562 is rotatably connected to the top surface of the top lid 560 by a rotation axis 562*a* or a hinge for binding the projector 831, and a lever mounting groove 563 is formed on the top surface of the top lid 560 for preventing the coupling lever 562 from being projected upwardly from the top surface of the top lid 560, the lever mounting groove including the projector 831 stably mounted thereon and the coupling lever 562 mounted thereon.

In other words, the filtering device 800 is attached to or detached from the top lid 560 by rotating the coupling lever 562 about the rotating axis 562*a* and selectively fixing the projector 831.

The filtering device may, of course, be coupled to the top lid 560 by providing a male screw (not shown) at the upper end of the filtering device, i.e., on the outer circumferential surface of the upper end supporter, and a female screw (not shown) on the inner circumferential surface of the upper end supporter.

In addition to the above structure, a filter handle 832 is provided on the upper surface of the upper end supporter 830. The filter handle 832 is provided at both sides on the top surface of the upper end supporter 830 for the user to easily move or hold the filtering device 800.

Figure 10:
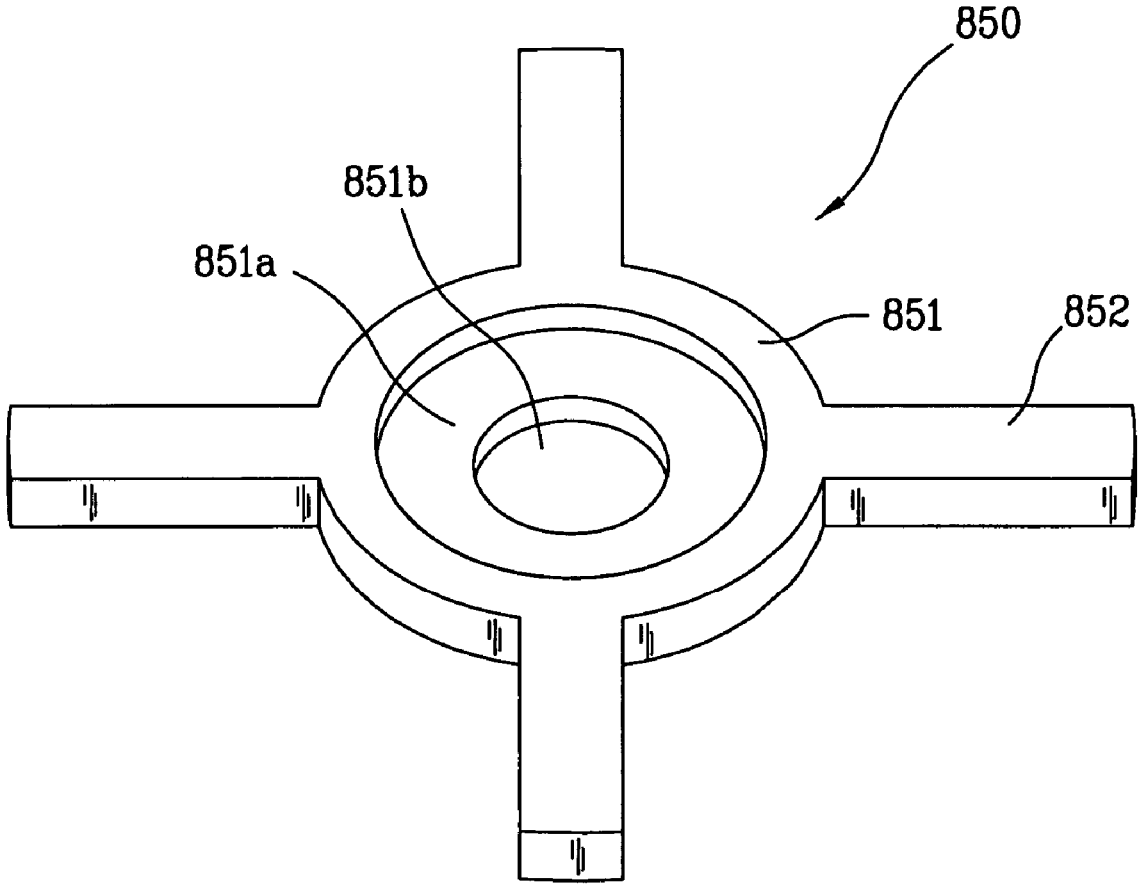
FIG. 10 illustrates a perspective view showing a first embodiment of a supplementary supporter of a filtering device provided in a vacuum cleaner in accordance with the present invention.

The filter supporter of the filtering device further includes a supplementary supporter 850 for fixing the lower end of the filtering device. If described in more detail with reference to FIG. 10, the supplementary supporter 850 includes a filter mounting member 851 having a groove 851*a* receiving and stably mounting the lower end of the filtering device and a clean air passage 851*b*, and a plurality of legs 852 radially protruded from the side of the filter mounting member and supported by the inner wall of the dust collecting container.

A process for attaching or detaching the filtering device 800 to the top lid 560 structured as abovementioned is described as follows.

First, when the filtering device 800 inserted through the pass through hole 561 of the top lid and the projector 831 of the top end supporter 830 is mounted in a lever mounting groove 563 of the top lid 560, the filtering device is provided tightly to the top lid 560 by rotating the coupling lever 562 to be overlapped to the top of the projector 831.

A process of detaching the filtering device 800 is in reverse order of the attaching process, and description of which will be omitted.

Figure 11:
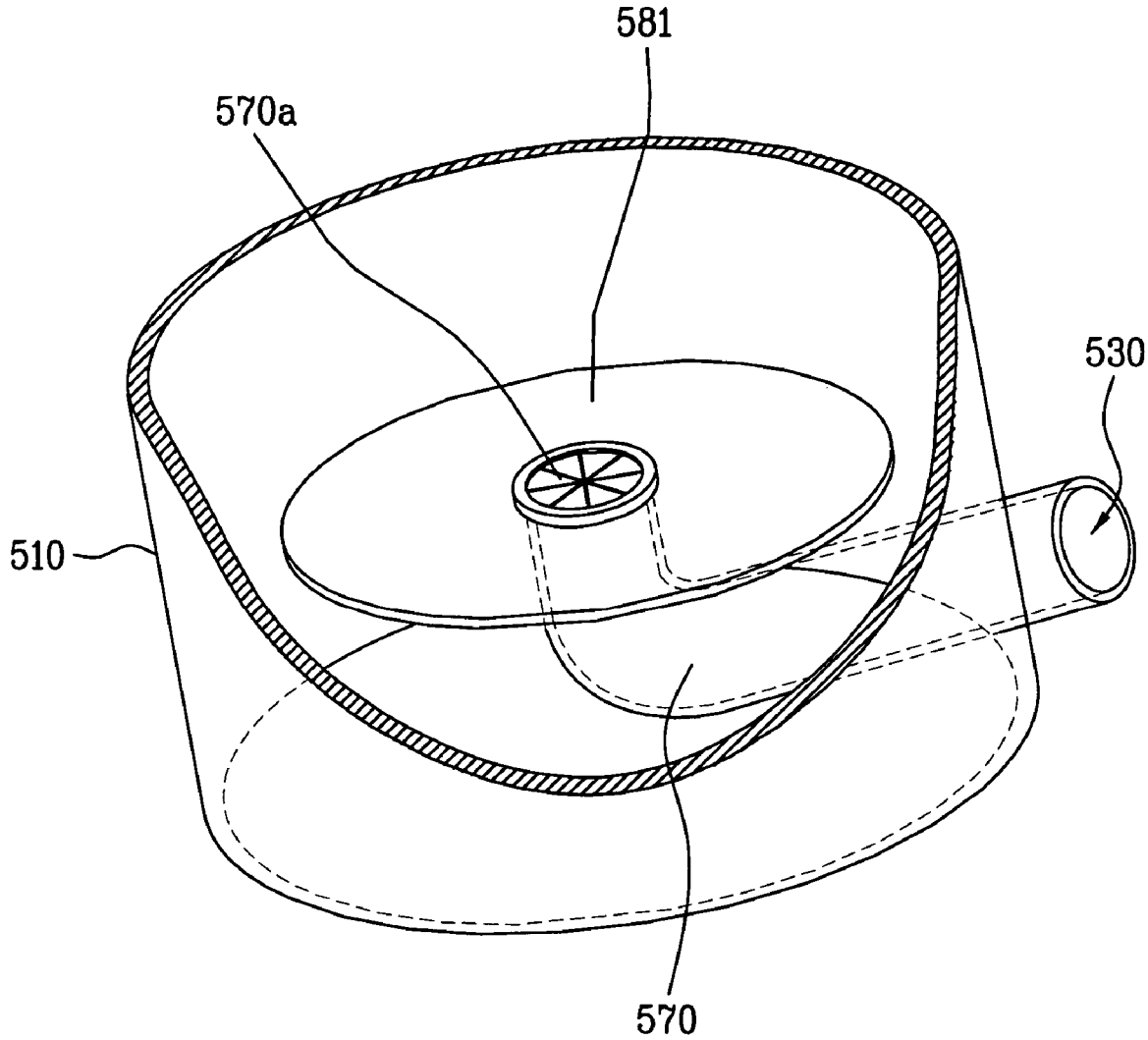
FIG. 11 illustrates a perspective view showing another preferred embodiment of a separation plate provided in a vacuum cleaner in accordance with the present invention.
Figure 12:
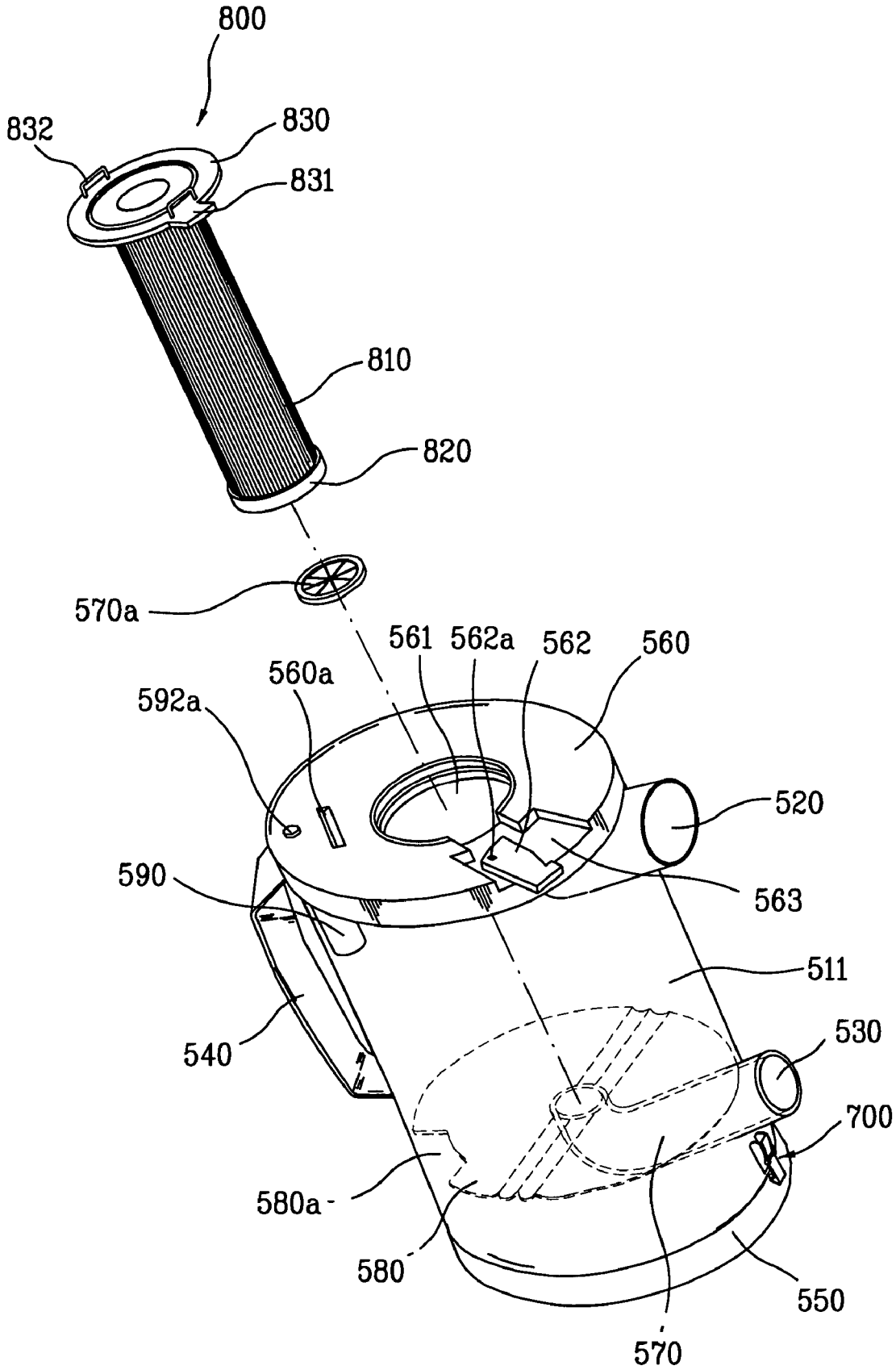
FIG. 12 illustrates a perspective view showing a third embodiment of a dust collecting assembly provided in a vacuum cleaner in accordance with the present invention.

The separate plate 580 includes two semi plates rotating upward as described in the first embodiment, or, as illustrated in FIG. 11, includes a round plate 581 incorporated integrally into the upper end of the inner flow tube 570, smaller than the inner diameter of the dust collecting container such that the impurities separated from the upper space of the dust collecting container are moved to the lower space thereof.

At the upper end of the inner flow tube 570 communicating with the clean air guiding passage 840 of the filtering device and guiding the clean air to the outside of the dust collecting container, a flow tube cover 570*a* is provided for preventing the impurities from being flowed into the inner flow tube 570. The flow tube cover 570*a* is formed in a round plate form which is radially incised and made of soft material such as rubber, so as to prevent the impurities from being flowed into the inside of the inner flow tube 570 when the filtering device is separated from the top lid 560, or when the top lid is opened in a state that the filtering device is attached.

Of the vacuum cleaner having the abovementioned structure in accordance with the present invention, the vacuum cleaner having the dust collecting assembly illustrated in FIGS. 8 and 9 is described as follows.

First, when the vacuum cleaner begins to function, the brush 12*b* provided at the suction nozzle 10 is rotated by operation of the motor in the cleaner body 20 so as to separate dust being stuck on the floor, and the fan coupled to the motor is rotated so as to suck the polluted air containing impurities such as dust through the main inlet of the suction nozzle 10.

The polluted air sucked through the main inlet is flowed into the dust collecting assembly through the polluted air outlet 24 of the cleaner body 20 communicating with the inlet of the dust collecting assembly 52.

Air drawn into the dust collecting assembly 500 flows cyclonically such that the large impurities are separated from the polluted air, passed through a hole 580*a* of the separation plate, and then collected at a lower part of the dust collecting container 510, i.e., inside the bottom lid 512.

In this instance, the separation plate 580 divides the dust collecting container into a top space and a bottom space so as to prevent the impurities collected at the lower part of the dust collecting container 510 from being rotated by the spiraled air formed in the dust collecting container, or from being risen to the upper space of the dust collecting container 510.

The air separated from the large impurities by the cyclone principle is cleaned while passing through the filtering device 800 for separating the fine dust.

In a process of collecting the impurities, the sprayer 590 prevents static electricity, destroys insects, or gives out a fragrance by spraying an antistatic, insecticide, or fragrance into the dust collecting assembly.

The fine dust separated by the filtering device 800 is collected in the dust collecting container, and the air cleaned by the filtering device 800 is guided by the inner flow tube 570 so as to be discharged through the outlet of the dust collecting assembly 530 and flowed into the clean air conduit having the clean air inlet 23.

The air flowed into the clean air conduit is passed through the fan and then discharged to the outside of the vacuum cleaner through the clean air exhausting port 25.

Next, referring to FIG. 12 to FIG. 15, a third embodiment of the dust collecting assembly provide at the vacuum cleaner in accordance with the present invention will be described.

The dust collecting assembly to be described hereinafter includes a dust collecting container with a bottom surface being openably and closably mounted thereon, and other parts are the same as the second embodiment, thus description for the same parts will be omitted.

In the present embodiment, a bottom surface of the dust collecting container 511 of the dust collecting assembly 500*a* is openably and closably mounted thereon such that the impurities collected in the dust collecting container is discharged to a lower part thereof, and other configurations are the same as the second embodiment abovementioned.

The dust collecting container includes a top container 511 having an openable top, a bottom lid 550 rotatably coupled to a first side of a lower end of the top container for opening and closing a lower part of the top container 511, a lid fixing device 700 provided at a second side of the lower end of the dust collecting container 511 for selectively fixing the bottom lid 550.

A front end of the bottom lid 550 is rotatably coupled to the front side of the lower end of the top container 511 by means of a hinge 551 and the lid fixing device 700 is provided at the rear side of the lower end of the top container 511 such that a rear end of the bottom lid 550 is selectively fixed.

In other words, when the lid fixing device 700 releases the bottom lid, the bottom lid 550 of the dust collecting container is opened by rotation, and the impurities collected in the lower space of the dust collecting container is exhausted to the outside of thereof. When discharge of the impurities is finished, the lid fixing device 700 fixes the bottom lid 550 so as to tightly close the bottom of the dust collecting container.

In more detail, the lid fixing device 700 includes a hook member 710 having a hook formed at a lower part thereof for hooking the second end of the bottom lid 550, and a hook supporter 720 having the hook member 710 rotatably coupled thereto by means of the rotation axis 710*a*. It is desirable that a projector 552 radially projected, or a hook receiving groove (not shown) is provided at the second end of the bottom lid 550 so as to be caught by the hook member 710.

An upper end 712 of the hook member 710 is coupled to an outer wall of the dust collecting container 511 by means of a compression spring 730, and the hook member 710 fixes the bottom lid 550 by restoring force of the compression spring 730. In this case, the hook member 710 may be formed in '<' form being bent to be symmetrical on the basis of the middle portion having the rotation axis coupled thereto.

The bottom lid may be fixed by the hook member provided at the bottom lid 550 and the projector provided on the outer wall of the top container 511.

Figure 13:
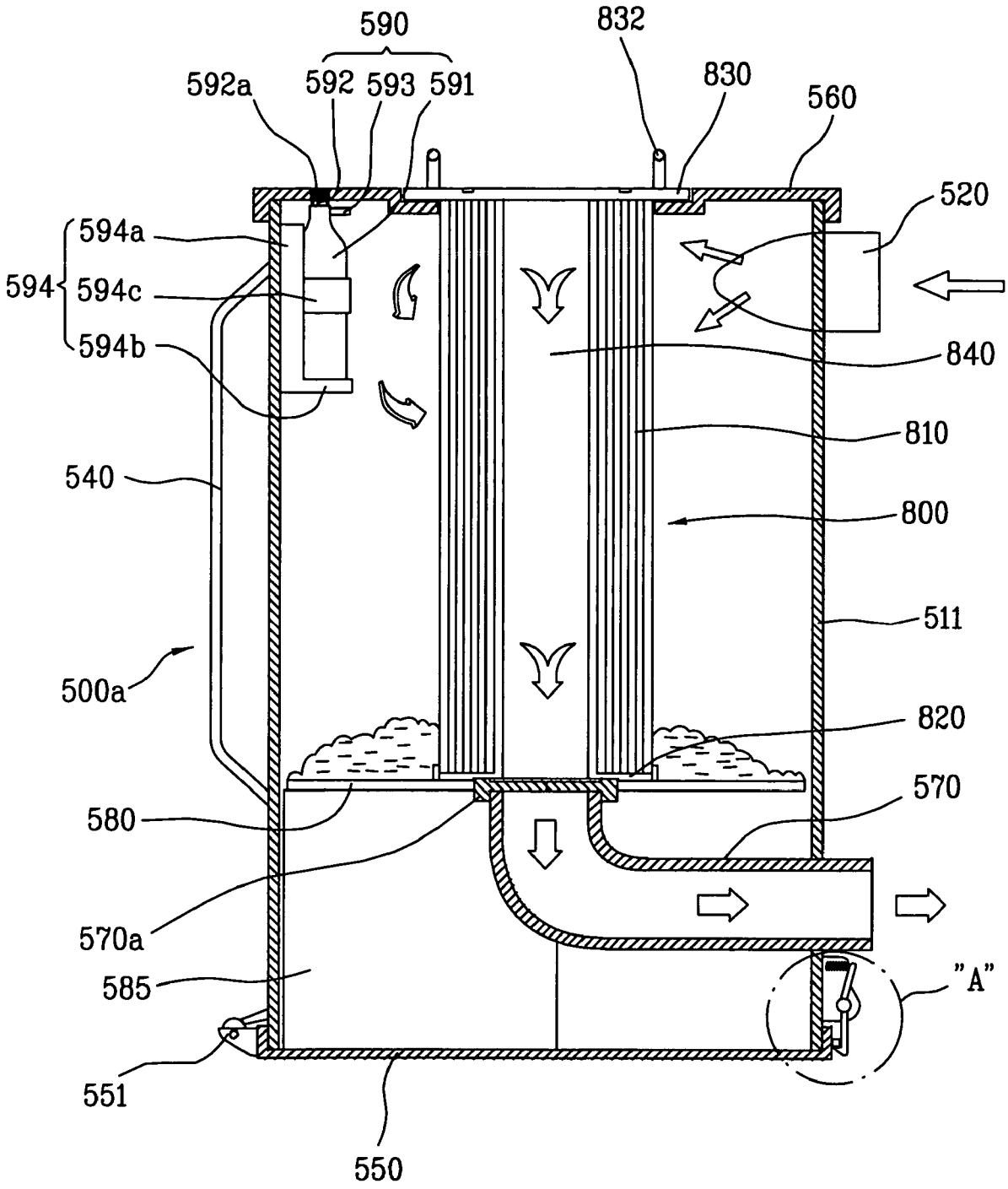
FIG. 13 illustrates a cross-sectional view showing the dust collecting assembly of FIG. 12.
Figure 14:
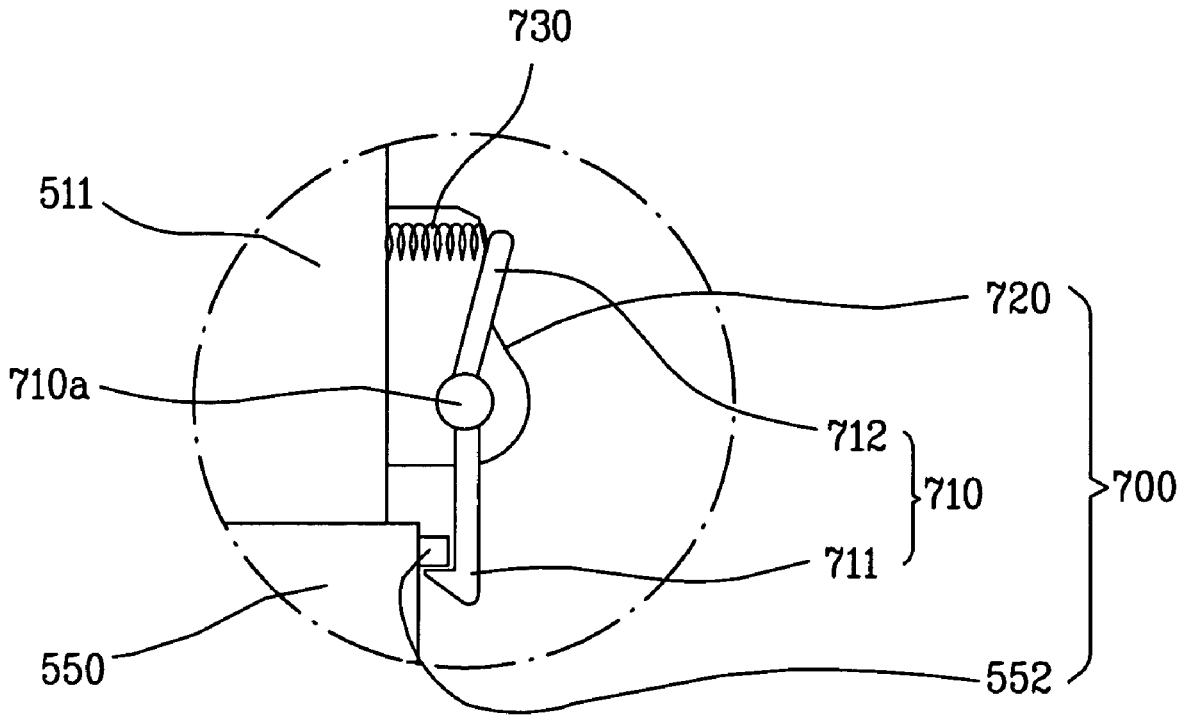
FIG. 14 illustrates a floor plan showing an amplified "A" section of FIG. 5.
Figure 15:
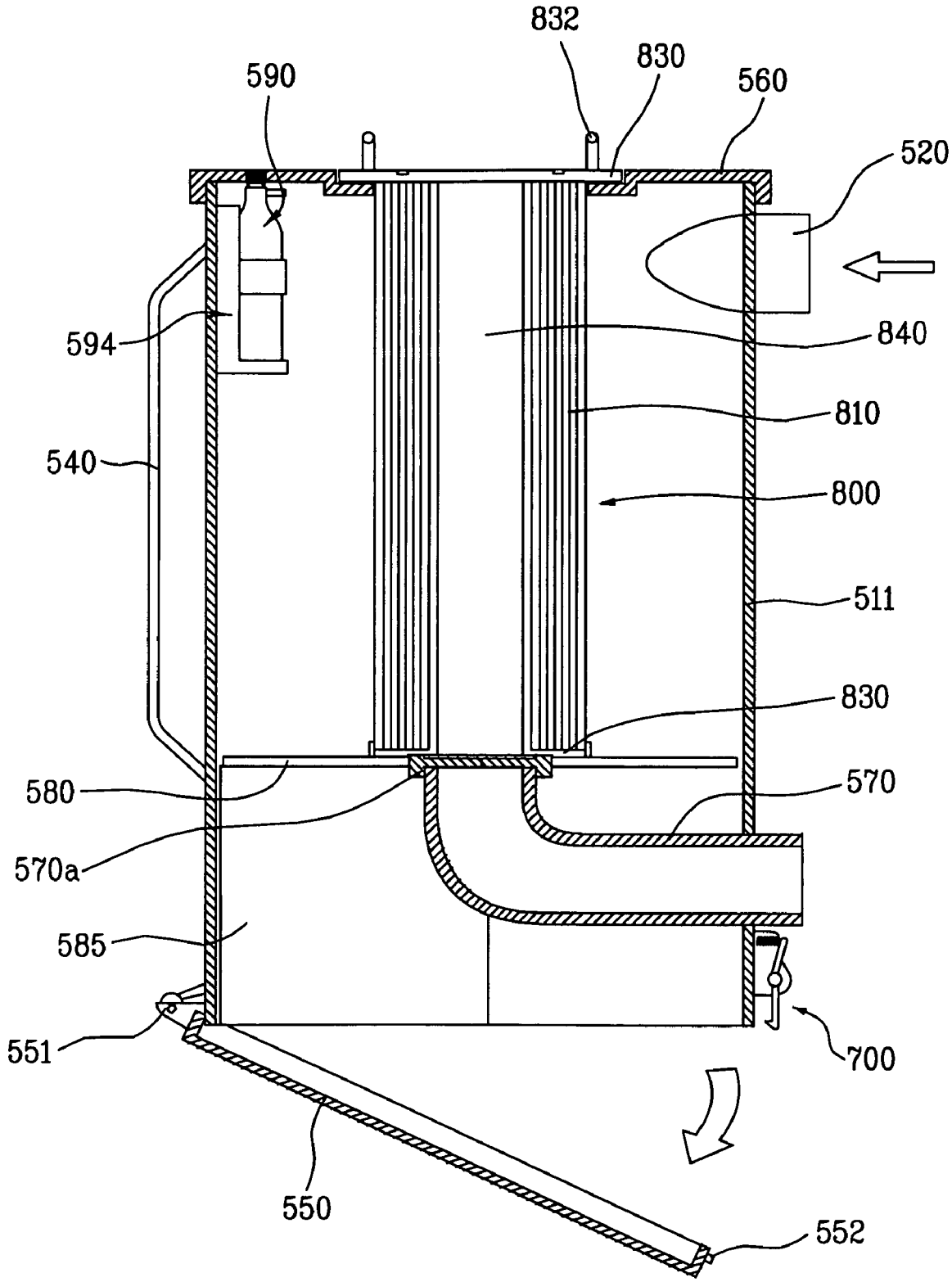
FIG. 15 illustrates a cross-sectional view showing an opened lower lid of the dust collecting assembly of FIG. 5.

Referring to FIG. 13 to FIG. 15, a process for opening and closing the bottom of the dust collecting container by means of the lid fixing device 700 structured as abovementioned will be described as follows.

First, for discharging the impurities in the dust collecting assembly, the user needs to release the bottom lid by pressing the top end 712 of the hook member in the direction of the outer wall of the dust collecting container when the bottom lid 550 is fixed by the lid fixing device 700 and the bottom of the dust collecting container is shut tightly.

Accordingly, the bottom lid rotates downward about the hinge 551 and opens the bottom of the dust collecting container, and the impurities in the dust collecting assembly are discharged outside by gravity.

When the discharge of the impurities is finished, the user tightly shuts the bottom of the dust collecting container by rotating the bottom lid 550 upwardly such that the projector 552 of the bottom lid 550 is caught by the hook member 710.

Meanwhile, the dust collecting container further includes an anti rotation plate 585 at a lower part thereof, the dust collecting container including the top container 511 and the bottom lid 550. The anti rotation plate 585 has a first end being coupled to an outer wall of the inner flow tube, a second end being coupled to an inner wall of the top container, and an upper end being close to a lower surface of the separation plate 580, so as to prevent the impurities collected in the lower space of the dust collecting container 51 from being scattered by the spiraled air.

Although the upright type vacuum cleaner having the cleaner body coupled with the upper part of the head is mainly discussed in the abovementioned embodiment of the present invention, the structure is not limited to the upright type vacuum cleaner, but can be applied to a canister type vacuum cleaner having the head and the cleaner body separately provided.

Figure 16:
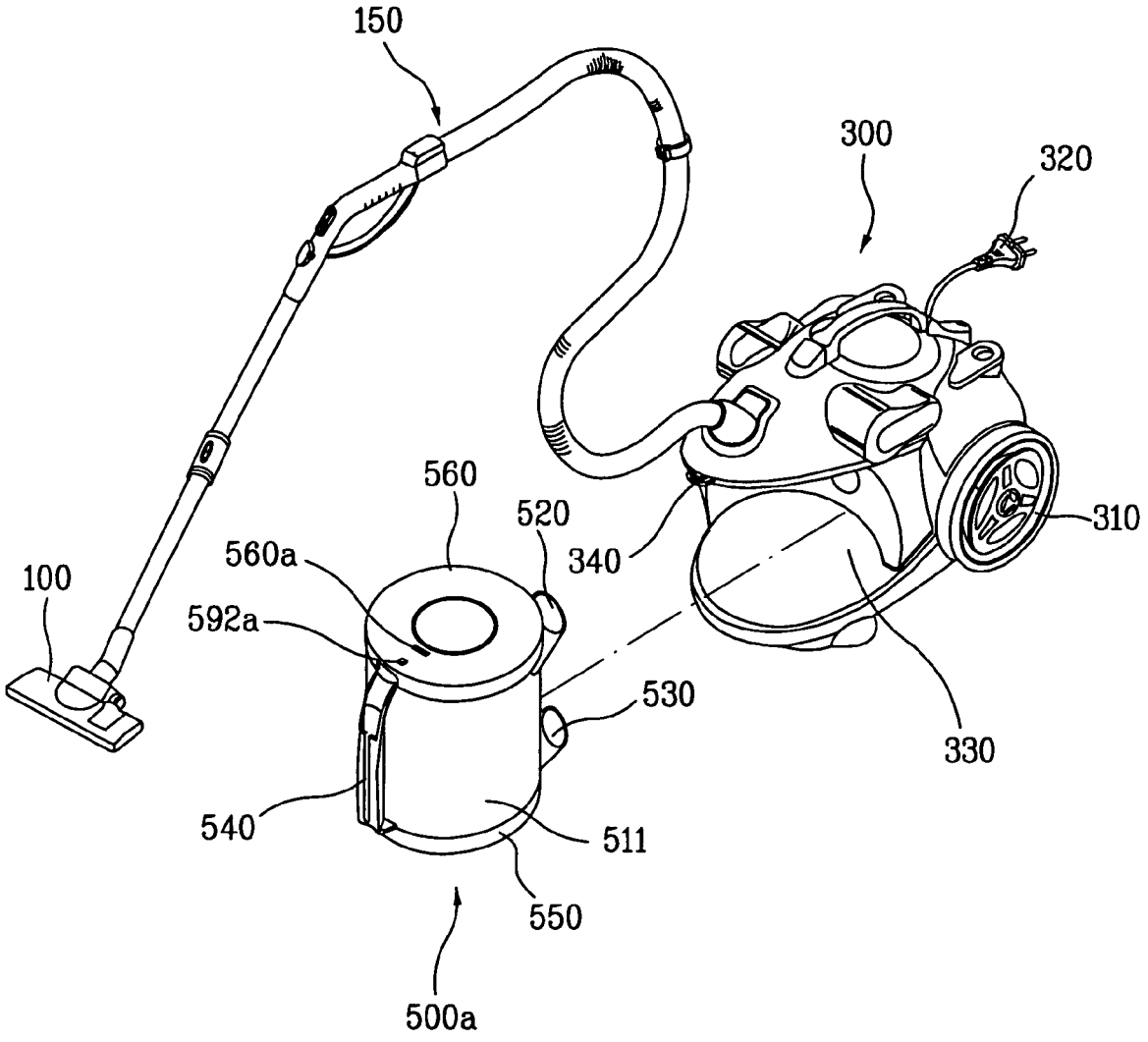
FIG. 16 illustrates a perspective view showing another embodiment of a vacuum cleaner in accordance with the present invention.

FIG. 16 illustrates a fragmentary perspective view showing an example that the third embodiment of the dust collecting assembly is applied to the canister type vacuum cleaner.

The canister type vacuum cleaner includes a suction nozzle 100 for sucking the impurities from outside, a cleaner body 300 having a dust collecting assembly receiving recess 330, to which the dust collecting assembly is mounted, and a coupling pipe 150 for coupling the suction nozzle 100 with the cleaner body 300 and guiding the polluted air to the cleaner body.

The cleaner body 300 includes a wheel 310, an electric wire 320, and a detaching device 340 for attaching and detaching the dust collecting assembly.

The dust collecting assembly 500*a* mounted at the dust collecting assembly receiving recess 330 of the cleaner body 300 structured as abovementioned separates and collects the impurities contained in the polluted air sucked through the suction nozzle 100.

The effect of the vacuum cleaner is summarized as follows. First, according to the vacuum cleaner in accordance with the present invention, the clean air inlet is provided on the rear inner wall of the dust collecting assembly receiving recess to face the front thereof. Therefore, even though carelessness of an inexperienced manipulation of the user caused a gap between the clean air inlet and the outlet of the dust collecting assembly during assembly of the dust collecting assembly, the airtighteness between the dust collecting assembly and the main body is maintained because air is sucked from the clean air inlet by the operation of the air sucking device and thus the dust collecting assembly is closely adhered to the rear side of the dust collecting assembly receiving recess by air suction force.

Second, according to the vacuum cleaner in accordance with the present invention, since the separation plate prevents the impurities collected in the lower space of the dust collecting container from being risen by dividing the inner space of the dust collecting container into the upper space and a lower space, thereby increasing dust collecting efficiency.

Third, according to the vacuum cleaner in accordance with the present invention, since the outlet of the dust collecting assembly coupled with the clean air inlet is projected to the outside of the dust collecting container or depressed to the inner side thereof, it is easy to couple the outlet with the clean air inlet, thereby making it easy to mount the dust collecting assembly.

Fourth, according to the vacuum cleaner in accordance with the present invention, since attaching and detaching of the filtering device provided in the dust collecting assembly is easy, exchanging and cleaning the filtering device are easy.

Fifth, according to the vacuum cleaner in accordance with the present invention, electrostatic phenomenon is prevented by operation of a sprayer provided in the dust collecting assembly so as to prevent the user from being shocked by static electricity. When an insecticide or a fragrance is stored in the sprayer, the inside of the sprayer is sterilized or an odor is removed.

Sixth, according to the vacuum cleaner in accordance with the present invention, since a bottom lid is provided for opening and closing a bottom of the dust collecting container, it is easy to discharge the impurities.

Seventh, according to the vacuum cleaner in accordance with the present invention, a top lid and the bottom lid are provided for opening and closing the top and bottom of the dust collecting container, thereby making it easy to discharge the impurities and to clean the dust collecting assembly.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A vacuum cleaner, comprising:

a suction nozzle that sucks an air containing impurities by operation of a motor;

a dust collecting assembly, comprising:

a dust collecting container comprising a dust collecting space that collects impurities therein and comprising an opened top;

a top lid that opens and closes the top of the dust collecting container, wherein a pass through hole is formed in the top lid;

an inlet that sucks the polluted air to the inside of the dust collecting container;

a filtering device that is detachably mounted in the pass through hole of the top lid such that the filtering device is inserted and withdrawn from an upper side of the top lid, wherein the filtering device filters impurities;

a separation plate that prevents the impurities collected in a lower part of the dust collecting container from being risen by air flow; and an outlet that exhausts clean air separated from the impurities to the outside of the dust collecting container; and a cleaner body, comprising:

a dust collecting assembly receiving recess that detachably receives the dust collecting assembly;

a polluted air outlet provided at the dust collecting assembly receiving recess, and communicating with the inlet of dust collecting assembly for discharging the polluted air to the dust collecting assembly, the polluted air sucked through the suction nozzle;

a clean air inlet provided on an inner wall of the dust collecting assembly receiving recess so as to face the direction of mounting of the dust collecting assembly and communicating with the outlet of the dust collecting assembly; and a clean air conduit comprising a fan provided therein and rotated by the motor, wherein a first end of the clean air conduit is coupled to the clean air inlet and a second end of the clean air conduit is coupled to a clean air outlet that exhausts the clean air to the outside of the vacuum cleaner.

2. The vacuum cleaner of claim 1, wherein the top lid is detachably provided at the top of the dust collecting container.

3. The vacuum cleaner of claim 1, wherein the filtering device is coupled to the top lid by means of a projector formed at a top end of the filtering device and a coupling lever provided on a top surface of the top lid that fixes the projector.

4. The vacuum cleaner of claim 1, wherein the filtering device comprises:

a filter formed in a cylindrical form that filters the impurities; and a filter supporter that supports the filter.

5. The vacuum cleaner of claim 1, wherein the dust collecting assembly is attached or detached from the front of the cleaner body.

6. The vacuum cleaner of claim 5, wherein the outlet of the dust collecting assembly is formed at a lower part of a rear side of the dust collecting container and the clean air inlet is formed at a lower part of a rear inner wall of the dust collecting assembly receiving recess.

7. The vacuum cleaner of claim 6, wherein the dust collecting assembly further comprises an inner flow tube comprising a first end communicating with the outlet of the dust collecting assembly and a second end communicating with the filtering device, thereby guiding clean air from the filtering device to the outside of the dust collecting container.

8. The vacuum cleaner of claim 7, wherein the inner flow tube of the dust collecting assembly comprises:

a first flow tube comprising a first end communicating with the outlet of the dust collecting assembly and a second end extended toward a center of the dust collecting container; and a second flow tube comprising a first end connected to the second end of the first flow tube and a second end extended upward to a lower end of the filtering device.

9. The vacuum cleaner of claim 8, wherein a connecting part of the first flow tube and the second flow tube is curved or inclined so as to minimize flow resistance of the clean air discharged from the dust collecting space.

10. The vacuum cleaner of claim 7, wherein the inner flow tube comprises a flow tube cover provided at the second end thereof so as to prevent the impurities from being flowed into the inside thereof.

11. The vacuum cleaner of claim 1, wherein the inlet of the dust collecting assembly is provided in a tangential direction at a predetermined location on a side of the dust collecting container such that the polluted air sucked into the inner space of the dust collecting container spirally flows.

12. The vacuum cleaner of claim 11, wherein the dust collecting assembly further comprises an anti rotation plate having a predetermined height and radially provided in the dust collecting container for preventing the impurities from being rotated by spiral air flow.

13. The vacuum cleaner of claim 1, wherein a bottom part of the dust collecting container is openable.

14. The vacuum cleaner of claim 13, wherein the dust collecting container comprises:

a top container comprising a top being openably and closably mounted thereon;

a bottom lid that is rotatably coupled to a first side of a lower end of the top container that opens and closes a bottom of the top container; and a lid fixing device provided at a second side of the lower end of the top container that selectively fixes the bottom lid.

15. The vacuum cleaner of claim 1, wherein the separation plate is opened by rotation when the impurities collected in the dust collecting container are exhausted.

16. The vacuum cleaner of claim 15, wherein the separation plate comprises two semicircular plates provided in the dust collecting container so that the semicircular plates rotate in an upper direction of the dust collecting container.

17. The vacuum cleaner of claim 1, wherein the cleaner body further comprises a packing member provided between the clean air inlet and the outlet of the dust collecting assembly that maintains an airtightness between the clean air inlet and the outlet of the dust collecting assembly.

18. A vacuum cleaner, comprising:

a suction nozzle that sucks in air containing impurities;

a dust collecting assembly, comprising:

a dust collecting container comprising a dust collecting space that collects the impurities therein and having an opened top;

a top lid that opens and closes the top of the dust collecting container, wherein a pass through hole is formed in the top lid;

an inlet that sucks air to the inside of the dust collecting container;

a filtering device that is detachably mounted in the pass through hole of the top lid such that the filtering device is inserted and withdrawn from an upper side of the top lid, wherein the filtering device filters impurities;

an outlet that exhausts clean air separated from the impurities to the outside of the dust collecting container, wherein the outlet is formed at a lower part of a rear side of the dust collecting container; and a cleaner body, comprising:

a dust collecting assembly receiving recess that detachably receives the dust collecting assembly;

a polluted air outlet provided on the dust collecting assembly receiving recess that communicates with the inlet of dust collecting assembly to deliver polluted air into the dust collecting assembly;

a clean air inlet provided on an inner wall of the dust collecting assembly receiving recess so as to face the direction of mounting of the dust collecting assembly and communicating with the outlet of the dust collecting assembly; and a clean air conduit, wherein a first end of the clean air conduit is coupled to the clean air inlet and a second end of the clean air conduit is coupled to a clean air outlet that exhausts the clean air to the outside of the vacuum cleaner.

19. The vacuum cleaner of claim 18, wherein the dust collecting assembly further comprises an inner flow tube having a first end communicating with the outlet of the dust collecting assembly and a second end communicating with the filtering device, and wherein the inner flow tube guides clean air from the filtering device to the outside of the dust collecting container.

20. The vacuum cleaner of claim 19, wherein the inner flow tube include a first section that extends horizontally from the outlet of the dust collecting assembly towards a center of the dust collecting container and a second portion that extends vertically the first section towards a lower end of the filtering device.

21. The vacuum cleaner of claim 20, wherein the inner flow tube includes a smooth bend between the first and second sections.

22. A vacuum cleaner, comprising:

a suction nozzle that sucks in air containing impurities;

a dust collecting assembly, comprising:

a dust collecting container comprising a dust collecting space that collects impurities therein and having an opened top;

a top lid that opens and closes the top of the dust collecting container, wherein a pass through hole is formed in the top lid;

an inlet that sucks air to the inside of the dust collecting container;

a filtering device that is detachably mounted in the pass through hole of the top lid such that the filtering device is inserted and withdrawn from an upper side of the top lid, wherein the filtering device filters impurities;

an outlet that exhausts clean air separated from the impurities to the outside of the dust collecting container; and an antirotation plate having a predetermined height and radially provided in the dust collecting container for preventing impurities from being rotated by spiral air flow; and a cleaner body, comprising:

a dust collecting assembly receiving recess that detachably receives the dust collecting assembly;

a polluted air outlet provided on the dust collecting assembly receiving recess that communicates with the inlet of dust collecting assembly to deliver polluted air into the dust collecting assembly;

a clean air inlet provided on an inner wall of the dust collecting assembly receiving recess and communicating with the outlet of the dust collecting assembly; and a clean air conduit, wherein a first end of the clean air conduit is coupled to the clean air inlet and a second end of the clean air conduit is coupled to a clean air outlet that exhausts the clean air to the outside of the vacuum cleaner.

23. A vacuum cleaner, comprising:

a suction nozzle that sucks air containing impurities;

a dust collecting assembly, comprising:

a dust collecting container comprising a dust collecting space that collects impurities therein and having an opened top;

a top lid that opens and closes the top of the dust collecting container, wherein a pass through hole is formed in the top lid;

an inlet that sucks air into the inside of the dust collecting container;

a filtering device that is detachably mounted in the pass through hole of the top lid such that the filtering device is inserted and withdrawn from an upper side of the top lid, wherein the filtering device filters impurities;

a separation plate that prevents the impurities collected in a lower part of the dust collecting container from being risen by air flow, wherein the separation plate is opened by rotation when the impurities collected in the dust collecting container are exhausted; and an outlet that exhausts clean air separated from the impurities to the outside of the dust collecting container; and a cleaner body, comprising:

a dust collecting assembly receiving recess that detachably receives the dust collecting assembly;

a polluted air outlet provided on the dust collecting assembly receiving recess that communicates with the inlet of dust collecting assembly for delivering air into the dust collecting assembly;

a clean air inlet provided on an inner wall of the dust collecting assembly receiving recess and communicating with the outlet of the dust collecting assembly; and a clean air conduit, wherein a first end of the clean air conduit is coupled to the clean air inlet and a second end of the clean air conduit is coupled to a clean air outlet that exhausts the clean air to the outside of the vacuum cleaner.

24. The vacuum cleaner of claim 23, wherein the separation plate comprises two semicircular plates provided in the dust collecting container so that the semicircular plates rotate in an upper direction of the dust collecting container.

* * * * *